US011746309B2

(12) United States Patent
Riehm et al.

(10) Patent No.: US 11,746,309 B2
(45) Date of Patent: Sep. 5, 2023

(54) ALKALINE WAREWASH DETERGENT COMPOSITION COMPRISING A TERPOLYMER AND METHODS TO PREVENT FOAMING, FILMING AND/OR REDEPOSITION

(71) Applicant: Ecolab USA Inc., Saint Paul, MN (US)

(72) Inventors: David Alexander Riehm, St. Paul, MN (US); Carter Martin Silvernail, Burnsville, MN (US); Kelly Anne Gilmore, Apple Valley, MN (US); John Matthew Chudomel, Aurora, IL (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 16/352,326

(22) Filed: Mar. 13, 2019

(65) Prior Publication Data

US 2019/0284505 A1 Sep. 19, 2019

Related U.S. Application Data

(60) Provisional application No. 62/642,441, filed on Mar. 13, 2018.

(51) Int. Cl.

| | |
|---|---|
| ***C11D 1/66*** | (2006.01) |
| ***C11D 1/722*** | (2006.01) |
| ***C11D 1/825*** | (2006.01) |
| ***C11D 3/10*** | (2006.01) |
| ***C11D 3/37*** | (2006.01) |

(Continued)

(52) U.S. Cl.

CPC ..... *C11D 3/10* (2013.01); *C11D 1/825* (2013.01); *C11D 3/044* (2013.01); *C11D 3/3707* (2013.01); *C11D 3/378* (2013.01); *C11D 3/3761* (2013.01); *C11D 3/386* (2013.01); *C11D 11/0035* (2013.01)

(58) Field of Classification Search

CPC ..... C11D 1/66; C11D 1/722; C11D 1/825; C11D 3/044; C11D 3/10; C11D 3/37; C11D 3/3707; C11D 3/378; C11D 3/386; B08B 3/04

See application file for complete search history.

(56) References Cited

U.S. PATENT DOCUMENTS

| | | | |
|---|---|---|---|
| 8,101,027 | B2 | 1/2012 | Vandermeulen et al. |
| 2009/0305934 | A1 | 12/2009 | Creamer et al. |

(Continued)

FOREIGN PATENT DOCUMENTS

| | | | |
|---|---|---|---|
| CA | 2696155 | A1 | 9/2010 |
| CN | 101171329 | A | 4/2008 |

(Continued)

OTHER PUBLICATIONS

"Chinese Application Serial No. 201980017160.8, Notification to Make Rectification dated Sep. 22, 2020", 1 pg.

(Continued)

*Primary Examiner* — Brian P Mruk

(74) *Attorney, Agent, or Firm* — Schwegman Lundberg & Woessner, P.A.

(57) ABSTRACT

Detergent compositions designed to prevent or inhibit build up of calcium carbonate while providing high cleaning performance on soils including inhibition of protein foaming, filming and redeposition on hard surfaces are disclosed. Methods of using the detergent compositions are also disclosed.

18 Claims, 5 Drawing Sheets

(51) Int. Cl.

| | |
|---|---|
| ***C11D 3/386*** | (2006.01) |
| ***B08B 3/04*** | (2006.01) |
| ***C11D 3/04*** | (2006.01) |
| *C11D 11/00* | (2006.01) |

(56) References Cited

U.S. PATENT DOCUMENTS

| | | | | |
|---|---|---|---|---|
| 2010/0167975 | A1* | 7/2010 | Vandermeulen | C11D 1/825 510/230 |
| 2010/0234264 | A1* | 9/2010 | Creamer | C11D 3/3761 510/229 |
| 2015/0099686 | A1 | 4/2015 | Silvernail et al. | |
| 2015/0099687 | A1 | 4/2015 | Walters et al. | |
| 2016/0068620 | A1* | 3/2016 | Tamareselvy | C08F 222/02 526/318.2 |
| 2017/0298299 | A1* | 10/2017 | Backer | C11D 3/3942 |

FOREIGN PATENT DOCUMENTS

| | | | |
|---|---|---|---|
| CN | 101528907 | A | 9/2009 |
| CN | 102311885 | A | 1/2012 |
| CN | 105209508 | A | 12/2015 |
| CN | 105765047 | A | 7/2016 |
| CN | 106103679 | A | 11/2016 |
| DE | 3743739 | A1 | 7/1989 |
| JP | 2010500431 | | 1/2010 |
| JP | 2014028870 | | 2/2014 |
| JP | 2017531075 | | 10/2017 |
| JP | 2017531707 | | 10/2017 |
| JP | 2021516717 | | 7/2021 |
| WO | WO-2008017620 | A1 | 2/2008 |
| WO | WO-2009123322 | A1 | 10/2009 |
| WO | WO-2012069365 | A1 | 5/2012 |
| WO | WO-2012069440 | A1 | 5/2012 |
| WO | 2015134404 | | 9/2015 |
| WO | WO-2016057391 | A1 | 4/2016 |
| WO | WO-2019178245 | A1 | 9/2019 |

OTHER PUBLICATIONS

"International Application Serial No. PCT/US2019/022074, International Preliminary Report on Patentability dated Sep. 24, 2020", 7 pgs.
"International Application Serial No. PCT/US2019/22074, International Search Report dated Jun. 26, 2019", 6 pgs.
"International Application Serial No. PCT/US2019/22074, Written Opinion dated Jun. 26, 2019", 7 pgs.
"Chinese Application Serial No. 201980017160.8, Office Action dated Apr. 7, 2021", w/English Translation, 17 pgs.
"European Application Serial No. 19713961.1, Response to Communication pursuant to Rules 161(1) and 162 EPC filed Apr. 26, 2021", 3 pgs.
"Chinese Application Serial No. 201980017160.8, Office Action dated Aug. 20, 2021", with English translation, 13 pages.
"Chinese Application Serial No. 201980017160.8, Office Action dated Apr. 7, 2021", with English claims, 15 pages.
"Japanese Application Serial No. 2020-547335, Notification of Reasons for Refusal dated Oct. 12, 2021", with English translation, 10 pages.
Han, Zhichao, "Study on the synthesis of IA MA AMPS terpolymer scale inhibitor", Applied Chemical Industry, (Feb. 28, 2015), 107-110.
Li, Fuxuan, "Synthesis and Characterization of Methacrylic Acid Itaconic Acid Allyl Sulfonate Supramolecular Dispersant", Polymer Materials Science and Engineering Cheng, (Mar. 31, 2009), 268-271.
"Canadian Application Serial No. 3,093,389, Non Final Office Action dated May 10, 2022", 4 pgs.
"Canadian Application Serial No. 3,093,389, Office Action dated Oct. 26, 2021", 5 pgs.
"Canadian Application Serial No. 3,093,389, Response filed Feb. 8, 2022 to Office Action dated Oct. 26, 2021", 68 pgs.
"Chinese Application Serial No. 201980017160.8, Decision of Rejection dated Jan. 27, 2022", w/ English translation, 10 pgs.
"Chinese Application Serial No. 201980017160.8, Response filed Nov. 4, 2021 to Office Action dated Aug. 20, 2021", w/English Claims, 16 pgs.
"Japanese Application Serial No. 2020-547335, Response filed Jan. 20, 2022 to Notification of Reasons for Refusal dated Oct. 12, 2021", w/ English claims, 21 pgs.
"Canadian Application Serial No. 3,093,389, Response filed Sep. 9, 22 to Non Final Office Action dated May 10, 2022", 18 pgs.
"Chinese Application Serial No. 201980017160.8, Response filed May 11, 2022 to Decision of Rejection dated Jan. 27, 2022", w/ Translation of English Claims), 15 pgs.
"Japanese Application Serial No. 2020-547335, Examiners Decision of Final Refusal dated May 31, 2022", (w/ English Translation), 10 pgs.
"Japanese Application Serial No. 2020-547335, Written Request for Trial and Appeal filed Sep. 30, 2022", 8 pgs.
"Canadian Application Serial No. 3,093,389, Examiners Rule 86(2) Report dated Jan. 26, 2023", 3 pgs.

* cited by examiner

ALKALINE WAREWASH DETERGENT COMPOSITION COMPRISING A TERPOLYMER AND METHODS TO PREVENT FOAMING, FILMING AND/OR REDEPOSITION

CROSS-REFERENCE TO RELATED APPLICATIONS

This application claims the benefit of the filing date of U.S. application No. 62/642,441, filed on Mar. 13, 2018, the disclosure of which is incorporated by reference herein.

FIELD OF THE INVENTION

The disclosure relates to detergent compositions designed to prevent or inhibit the build up of calcium carbonate and optionally prevent or inhibit protein foaming, protein redeposition, and/or filming while providing high cleaning performance on glassware, plastics and other hard surfaces.

BACKGROUND

Conventional detergents used in warewashing include alkaline detergents. Alkaline detergents are commonly used to remove food soil (grease, starch, and protein) from glass, plastic, and melamine dishes, defoam food soil in the wash sump, and mitigate redeposition of food soil on dishes. There is currently a need for detergents which minimize hard scale build up, defoam food soil including protein soil and reduce the redeposition of, for example, protein, e.g., at high food soil concentrations.

SUMMARY

An alkaline detergent composition is provided comprising one or more distinct terpolymers comprising acrylic acid, maleic acid or itaconic acid, or mixtures thereof, and a sulfonic acid, such as vinyl sulfonic acid, allyl sulfonic acid, methallyl sulfonic acid, styrene sulfonic acid, or 2-acrylamido-2-methylpropane sulfonic acid, or mixtures thereof. In one embodiment, the detergent composition comprises from about 1 wt-% to about 20 wt-% of the terpolymer; from about 1 wt-% to about 15 wt-% of the terpolymer; from about 1 wt-% to about 10 wt-% of the terpolymer; or from about 5 wt-% to about 15 wt-% of the terpolymer. In one embodiment the composition does not include a silicate, e.g., a water soluble silicate. In one embodiment, the composition does not include a phosphonate. In one embodiment, the composition does not include a citrate. In one embodiment, the composition does not include a bleaching agent. In one embodiment, the composition does not include a polyglycoside. In one embodiment, the composition does not include silicon. In one embodiment, the terpolymer has a molecular weight of about 1,000 to about 50,000, e.g., about 1,000 to about 20,000, or about 1,000 to about 10,000. The terpolymer containing detergent compositions show improved performance relating to the buildup of calcium carbonate on surfaces including but not limited to glass and plastic surfaces.

Also provided is an alkaline detergent composition that prevents or inhibits protein foaming, filming, redeposition, or any combination thereof, on hard surfaces, such as on plastic, glass, and melamine dishes, e.g., in institutional warewash applications, under conditions including but not limited to high temperatures, high water hardness or high soil concentration. In one embodiment, the alkaline detergent composition that mitigates protein foaming, filming, redeposition, or a combination thereof, on hard surfaces, e.g., dishes, comprises a combination of at least two surfactants, e.g., at least two non-ionic surfactants, at least one of which optionally has defoaming properties.

Also provided is an alkaline detergent composition that comprises at least one surfactant, e.g., a non-ionic surfactant which optionally lacks defoaming properties, and may include the terpolymer described herein.

In one embodiment, one of the surfactants comprises an alkoxylated diol, triol or tetrol. In one embodiment, the alkaline detergent composition comprises from about 1 wt-% to about 10 wt-% of the two surfactants and the alkoxylated diol, triol or tetrol comprises from about 10 wt-% to about 90 wt-%; from about 10 wt-% to about 80 wt-%; from about 15 wt-% to about 60 wt-%; or from about 15 wt-% to about 40 wt-% of the combined weight of the two surfactants. In one embodiment, the alkoxylated diol, triol or tetrol has about 10 wt-% to about 80 wt-% ethylene oxide (EO) and about 20 wt-% to about 90 wt-% propylene oxide (PO). In one embodiment, the alkoxylated diol, triol or tetrol has about 20 wt-% to about 60 wt-% ethylene oxide and about 40 wt-% to 80 wt-% propylene oxide. In one embodiment, the alkoxylated diol, triol or tetrol has about 25 wt-% to about 55 wt-% ethylene oxide and about 45 wt-% to about 85 wt-% propylene oxide. In one embodiment, the molecular weight of the alkoxylated diol, triol or tetrol is about 1,500 to about 10,000, about 2,000 to about 8,000, about 2,000 to about 6,000, or about 2,000 to 4,000. In one embodiment, one of the alkoxylated diol, triol or tetrol surfactants comprises Dowfax® DF-112. In one embodiment, one of the alkoxylated diol, triol or tetrol surfactants comprises Dowfax® DF-114.

In one embodiment, one of the surfactants comprises an alkoxylated ethylenediamine. In one embodiment, the alkaline detergent composition comprises from about 1 wt-% to about 10 wt-% of the two surfactants, and the alkoxylated ethylenediamine comprises from about 10 wt-% to about 90 wt-%; from about 20 wt-% to about 80 wt-%; from about 30 wt-% to about 70 wt-%; from about 40 wt-% to about 65 wt-%; or from about 50 wt-% to about 65 wt-% of the combined weight of the two surfactants. In one embodiment, the alkoxylated ethylenediamine has about 10 wt.-% to about 80 wt-% ethylene oxide and about 20 wt-% to 90 wt-% propylene oxide. In one embodiment, the alkoxylated ethylenediamine has about 20 wt-% to about 70 wt-% ethylene oxide and about 20 wt-% to 80 wt-% propylene oxide. In one embodiment, the alkoxylated ethylenediamine has about 30 wt-% to about 60 wt-% ethylene oxide and about 40 wt-% to 70 wt-% propylene oxide. In one embodiment, the molecular weight of the alkoxylated ethylenediamine is about 2,000 to about 10,000, about 3,000 to about 10,000, or about 4,000 to 9,000. In one embodiment, one of the non-ionic surfactants comprises Tetronic® 90R4.

In one embodiment, one of the surfactants comprises a poly(propylene oxide)-poly(ethylene oxide)-poly(propylene oxide) block copolymer. In one embodiment, the alkaline detergent composition comprises from about 1 wt-% to about 10 wt-% of the two surfactants, and the poly(propylene oxide)-poly(ethylene oxide)-poly(propylene oxide) block copolymer comprises from about 10 wt-% to about 90 wt-%; from 20 wt-% to about 80 wt-%; from about 15 wt-% to about 60 wt-%; or from about 15 wt-% to about 50 wt-% of the combined weight of the two surfactants. In one embodiment, the ratio of EO to PO in the poly(propylene oxide)-poly(ethylene oxide)-poly(propylene oxide) block copolymer is 3:7, 2:8, or 4:6. In one embodiment, one of the non-ionic surfactants comprises Pluronic® N3. In one embodiment, one of the non-ionic surfactants comprises Pluronic® 25R2.

In an embodiment, the detergent composition comprises an alkali metal hydroxide or an alkali metal carbonate. In one embodiment, the detergent composition is a solid. In one embodiment, the detergent composition is an aqueous liquid.

Methods of using the detergent compositions are provided.

Further provided is, in one embodiment, a terpolymer comprising about 70 wt-% to about 90 wt-% acrylic acid, about 5 wt-% to about 19 wt-% maleic acid, and about 1 wt-% to about 15 wt % 2-acrylamido 2-methylpropane, vinyl, styrene, allyl or methallyl sulfonic acid. In one embodiment, a terpolymer comprises about 70 wt-% to about 90 wt-% acrylic acid, about 5 wt-% to about 35 wt-% itaconic acid, and about 1 wt-% to about 15 wt % 2-acrylamido 2-mnethylpropane, vinyl, styrene, allyl or methallyl sulfonic acid.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1A:
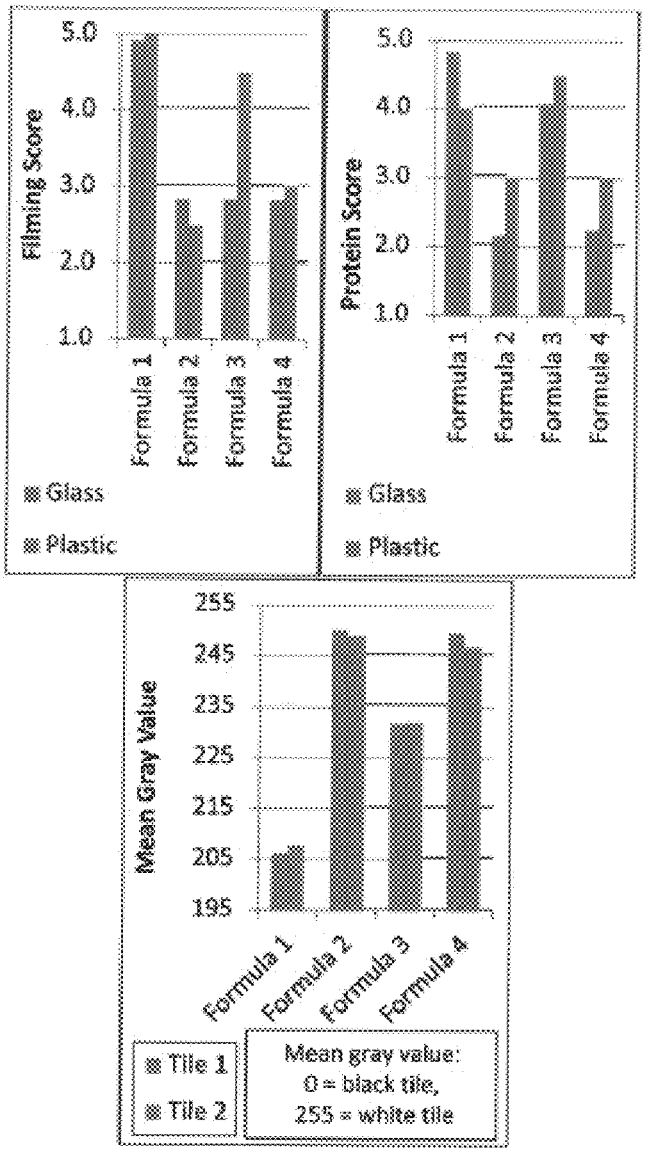
FIG. 1A. Foaming and filming results from alkaline detergent compositions comprising Tetronic 90R4, Dowfax DF-114, or combinations thereof.

Various embodiments of the present disclosure will be described in detail. Reference to various embodiments does not limit the scope of the disclosure. Figures represented herein are not limitations to the various embodiments according to the disclosure and are presented for exemplary illustration of the disclosure. For instance, embodiments are not limited to particular detergent compositions having a terpolymer but may include compositions having at least two surfactants, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of this disclosure are presented in a range format. It should be understood that the description in range format is merely for convenience and brevity and should not be construed as an inflexible limitation on the scope of the disclosure. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

So that the present disclosure may be more readily understood, certain terms are first defined. Unless defined otherwise, all technical and scientific terms used herein have the same meaning as commonly understood by one of ordinary skill in the art to which embodiments of the disclosure pertain. Many methods and materials similar, modified, or equivalent to those described herein can be used in the practice of the embodiments of the present disclosure without undue experimentation, exemplary materials and methods are described herein. In describing and claiming the embodiments of the present disclosure, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

"Alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

An "antiredeposition agent" refers to a compound that helps keep suspended in water instead of redepositing onto the object being cleaned. Antiredeposition agents are useful to assist in reducing redepositing of the removed soil onto the surface being cleaned.

As used herein, the term "cleaning" refers to a method used to facilitate or aid in soil removal.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces.

As used herein, the term "polymer" generally includes, but is not limited to, homopolymers, copolymers, such as for example, block, graft, random and alternating copolymers, terpolymers, and higher "x"mers, further including their derivatives, combinations, and blends thereof. Furthermore, unless otherwise specifically limited, the term "polymer" shall include all possible isomeric configurations of the molecule including, but are not limited to isotactic, syndiotactic and random symmetries, and combinations thereof. Furthermore, unless otherwise specifically limited, the term "polymer" shall include all possible geometrical configurations of the molecule.

As used herein, the term "soil" refers to polar or non-polar organic or inorganic substances including, but not limited to carbohydrates, proteins, fats, oils and the like. These substances may be present in their organic state or complexed to a metal to form an inorganic complex.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

The term "threshold agent" refers to a compound that inhibits crystallization of water hardness ions from solution, but that need not form a specific complex with the water hardness ion. Threshold agents include but are not limited to a polyacrylate, a polymethacrylate, an olefin/maleic copolymer, and the like.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. The term "ware" generally refers to items such as eating and cooking utensils, dishes, and other hard surfaces. Ware also refers to items made of various substrates, including glass, ceramic, china, crystal, metal, plastic or natural substances such, but not limited to clay, bamboo, hemp and the like. Types of plastics that can be cleaned with the compositions according to the disclosure include but are not limited to, those that include polypropylene (PP), high density polyethylene (HDPE), low density polyethylene (LDPE), polyvinyl chloride (PVC), syrene acrylonitrile (SAN), polycarbonate (PC), melamine formaldehyde resins or melamine resin (melamine), acrilonitrile-butadiene-styrene (ABS), and polysulfone (PS). Other exemplary plastics that can be cleaned using the compounds and compositions of the disclosure include polyethylene terephthalate (PET) polystyrene polyamide.

The term "weight percent," "-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions disclosed herein may comprise, consist essentially of, or consist of the components and ingredients of the present disclosure as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Detergent Compositions

Detergent compositions according to the present disclosure provide alkali metal alkaline detergents for cleaning a variety of industrial and consumer surfaces, e.g., surfaces used in the food and beverage, textile, warewash, and health care industries.

The detergent compositions comprise, consist of and/or consist essentially of an alkali metal carbonate and/or alkali metal hydroxide alkalinity source, and one or more polymers, e.g., terpolymers that include maleic acid or itaconic acid, acrylic acid and a sulfonate, and optionally at least one additional functional ingredient. In one embodiment, the detergent compositions comprise, consist of and/or consist essentially of an alkali metal carbonate and/or alkali metal hydroxide alkalinity source, and two or more surfactants, e.g., at least two non-ionic surfactants, and optionally at least one additional functional ingredient. In one embodiment, the detergent compositions comprise, consist of and/or consist essentially of an alkali metal carbonate and/or alkali metal hydroxide alkalinity source, a terpolymer that includes maleic acid or itaconic acid, acrylic acid and a sulfonate, and two or more surfactants, e.g., at least two non-ionic surfactants. In yet another embodiment, the detergent compositions comprise, consist of and/or consist essentially of an alkali metal carbonate and/or alkali metal hydroxide alkalinity source, a terpolymer that includes maleic acid or itaconic acid, acrylic acid and a sulfonate, two or more surfactants, e.g., at least two non-ionic surfactants, and at least one optional additional functional ingredients.

Exemplary ranges of amounts of components in the solid detergent compositions include but are not limited to 1 wt-% to 80 wt-%, 5 wt-% to 70 wt-%, 20 wt-% to 70 wt-%, 25 wt-% to 70 wt-%, or 45 wt-% to 70 wt-% of an alkalinity source comprising an alkali metal carbonate and/or an alkali metal hydroxide and in one embodiment 1 wt-% to 15 wt-%, 1 wt-% to 10 wt-%, 5-wt % to 15 wt-%, or 5 wt-% to 10 wt-% of a terpolymer; or amounts of components in the solid detergent compositions include but are not limited to 1 wt-% to 80 wt-%, 5 wt-% to 70 wt-%, 20 wt-% to 70 wt-%, 25 wt-% to 70 wt-%, or 45 wt-% to 70 wt-% of an alkalinity source comprising an alkali metal carbonate and/or an alkali metal hydroxide and in one embodiment 1-wt % to 10 wt-%, 1-wt % to 8 wt-%, 1-wt % to 6 wt-%, or 1-wt % to 4 wt-% of two non-ionic surfactants.

The solid detergent compositions may include solid concentrate compositions. A "solid" composition refers to a composition in the form of a solid such as a powder, a particle, agglomerate, a flake, a granule, a pellet, a tablet, a lozenge, a puck, a briquette, a brick, a solid block, a unit dose, or another solid form known to those of skill in the art. The term "solid" refers to the state of the detergent composition under the expected conditions of storage and use of the solid detergent composition. In general, it is expected that the detergent composition may remain in solid form when exposed to elevated temperatures of 100 degrees F., 112 degrees F., or 120 degrees F. A cast, pressed, or extruded "solid" may take any form including a block. When referring to a cast, pressed, or extruded solid it is meant that the hardened composition will not flow perceptibly and will substantially retain its shape under moderate stress, pressure, or mere gravity. For example, the shape of a mold when removed from the mold, the shape of an article as formed upon extrusion from an extruder, and the like. The degree of hardness of the solid cast composition can range from that of a fused solid block, which is relatively dense and hard similar to concrete, to a consistency characterized as being malleable and sponge-like, similar to caulking material.

The alkaline detergent compositions can be made available as concentrates that are diluted (or as multiple concentrates that are diluted and combined) prior to or at the point of use to provide a use solution for application a variety of surfaces, namely hard surfaces. An advantage of providing concentrates that are later combined is that shipping and storage costs can be reduced because it can be less expensive to ship and store a concentrate rather than a use solution and is also more sustainable because less packaging is used.

Alkalinity Source

In an aspect the detergent compositions include an alkalinity source. In an aspect, the alkalinity source is selected from an alkali metal hydroxide and alkali metal carbonate. Suitable alkali metal hydroxides and carbonates include, but are not limited to sodium carbonate, potassium carbonate, sodium hydroxide and potassium hydroxide. Any "ash-based" or "alkali metal carbonate" shall also be understood to include all alkali metal carbonates, metasilicates, silicates, bicarbonates and/or sesquicarbonates. In one embodiment, "alkali metal carbonate" does not include metasilicates, silicates, bicarbonates and/or sesquicarbonates. In one aspect, the alkalinity source is an alkali metal carbonate. In some aspects, the alkaline cleaning compositions do not include organic alkalinity sources.

The source of alkalinity is provided in an amount sufficient to provide the use solution with a pH of at least about 8, at least about 9, at least about 10, at least about 11, or at least about 12. The use solution pH range is for example between about 8.0 and about 13.0, and in another example between about 10 to 12.5.

In one embodiment, the compositions include from about 1 wt-% to about 80 wt-% alkalinity source, from about 10 wt-% to about 75 wt-% alkalinity source, from about 20 wt-% to about 75 wt-% alkalinity source, or from about 40 wt-% to about 75 wt-% alkalinity source. In addition, without being limited according to the disclosure, all ranges recited are inclusive of the numbers defining the range and include each integer within the defined range.

Polymers Including Terpolymers

In one embodiment, the detergent compositions include a terpolymer of maleic acid or itaconic acid, acrylic acid and a sulfonic acid. Suitable terpolymers have a molecular weight of about 1,000 to 50,000, about 1,000 to about 20,000, about 1,000 to 10,000 or about 1,000 to about 6,000.

The detergent compositions may include other polymers in combination with the terpolymer or may include along with at least two surfactants other polymers such as a polymaleic acid homopolymer, polyacrylic acid homopolymer, and polycarboxylates. Exemplary polycarboxylates that can be used as builders and/or water conditioning polymers include, but are not limited to: those having pendant carboxylate (—CO2-) groups such as polyacrylic acid homopolymers, polymaleic acid homopolymers, maleic/olefin copolymers, sulfonated copolymers or terpolymers, acrylic/maleic copolymers or terpolymers, polymethacrylic acid homopolymers, polymethacrylic acid copolymers or terpolymers, acrylic acid-methacrylic acid copolymers, hydrolyzed polyacrylamides, hydrolyzed polymethacrylamides, hydrolyzed polyamide-methacrylamide copolymers, hydrolyzed polyacrylonitriles, hydrolyzed polymethacrylonitriles, hydrolyzed acrylonitrile-methacrylonitrile copolymers and combinations thereof. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at sub stoichiometric levels to function as crystal modifiers.

In one embodiment, the compositions include from about 1 wt-% to about 30 wt-% of the terpolymer, or terpolymer and other polymers, or polymers other than the terpolymer, from about 1 wt-% to about 20 wt-% of the terpolymer, or terpolymer and other polymers, or polymers other than the terpolymer, from about 1 wt-% to about 15 wt-% of the terpolymer, or terpolymer and other polymers, or polymers other than the terpolymer, and may be from about 1 wt-% to about 10 wt-% of the terpolymer, or terpolymer and other polymers, or polymers other than the terpolymer. In a further aspect, the compositions include from about 1 wt-% to about 20 wt-% of the terpolymer, from about 1 wt-% to about 15 wt-% of the terpolymer, from about 1 wt-% to about 10 wt-% of the terpolymer, from about 2.5 wt-% to about 15 wt-%, or from about 2.5 wt-% to about 10 wt-% of the terpolymer. In addition, without being limited according to the disclosure, all ranges recited are inclusive of the numbers defining the range and include each integer within the defined range.

Non Ionic Surfactants

In an aspect, the detergent compositions may include at least two non-ionic surfactants, e.g., the terpolymer containing detergent compositions may optionally include two or more non-ionic surfactants, e.g., a nonionic alkoxylated surfactant. Exemplary suitable alkoxylated surfactants include ethylene oxide/propylene block copolymers (EO/PO copolymers), such as those available under the name Pluronic®, capped EO/PO copolymers, alcohol alkoxylates, capped alcohol alkoxylates, mixtures thereof, or the like.

Nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

In one embodiment, the nonionic surfactant useful in the composition is a low-foaming nonionic surfactant. Examples of nonionic low foaming surfactants useful in the present compositions include:

1) block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp. Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from 1,000 to 4,000. Ethylene oxide is then added to sandwich this hydrophobe between hydrophilic groups, controlled by length to constitute from about 10% by weight to about 80% by weight of the final molecule. Tetronic® compounds are tetra-functional block copolymers derived from the sequential addition of propylene oxide and ethylene oxide to ethylenediamine. The molecular weight of the propylene oxide hydrotype ranges from 500 to 7,000; and, the hydrophile, ethylene oxide, is added to constitute from 10% by weight to 80% by weight of the molecule.

2) alkoxylated diamines produced by the sequential addition of propylene oxide and ethylene oxide to ethylenediamine. The hydrophobic portion of the molecule weighs from 250 to 6,700 with the central hydrophile including 0.1% by weight to 50% by weight of the final molecule. Examples of commercial compounds of this chemistry are available from BASF Corporation under the tradename Tetronic™ Surfactants and 3) alkoxylated diamines produced by the sequential addition of ethylene oxide and propylene oxide to ethylenediamine. The hydrophobic portion of the molecule weighs from 250 to 6,700 with the central hydrophile including 0.1% by weight to 50% by weight of the final molecule. Examples of commercial compounds of this chemistry are available from BASF Corporation under the tradename Tetronic R™ Surfactants.

Those compounds may be modified by "capping" or "end blocking" the terminal hydroxy group or groups (of multifunctional moieties) to reduce foaming by reaction with a small hydrophobic molecule such as propylene oxide, butylene oxide, benzyl chloride; and, short chain fatty acids, alcohols or alkyl halides containing from 1 to 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Exemplary Detergent Compositions

In one embodiment, the alkaline detergent compositions comprise an alkalinity source and a terpolymer comprising acrylic acid, maleic acid or itaconic acid, and 2-acrylamido 2-methlylpropane sulfonic acid, vinyl sulfonic acid, styrene sulfonic acid, allyl sulfonic acid or methallyl sulfonic acid, and optionally at least two non-ionic surfactants. In one embodiment, the alkaline detergent compositions comprise from about 1 wt-% to 80 wt-% sodium hydroxide or sodium carbonate and from about 1 wt-% to about 20 wt-%, about 1 wt-% to about 15 wt-%, about 2.5 wt-% to about 15 wt-%, or from about 2.5 wt-% to about 10 wt-% of the terpolymer. In one embodiment, the terpolymer comprises about 70 wt-% to about 90 wt-% acrylic acid, about 5 wt-% to about 25 wt-% maleic or itaconic acid, and about 1 wt-% to about 15 wt % 2-acrylamido 2-methylpropane, vinyl, styrene, allyl or methallyl sulfonic acid. In one embodiment, the terpolymer has a molecular weight of about 1,000 to about 50,000, e.g., about 1,000 to about 20,000, about 1,000 to about 10,000.

In one embodiment, the alkaline detergent compositions comprise an alkalinity source and at least two non-ionic surfactants. In one embodiment, the non-ionic surfactants comprise an alkoxylated triol and an alkoxylated ethylenediamine, and the alkaline detergent compositions comprise from about 1 wt-% to about 80 wt-% sodium hydroxide or sodium carbonate, and from about 1 wt-% to about 10 wt-% of the two surfactants. In one embodiment, the alkoxylated triol comprises from about 10 wt-% to about 80 wt-%; 10 wt-% to about 60 wt-%; from about 15 wt-% to about 50 wt-%; or from about 15 wt-% to about 40 wt-% of the combined weight of the two surfactants. In one embodiment, the alkoxylated triol has about 30 wt-% to about 70 wt-% ethylene oxide (EO) and about 30 wt-% to 70 wt-% propylene oxide (PO). In one embodiment, the alkoxylated triol has about 20 wt-% to about 60 wt-% ethylene oxide and about 40 wt-% to 80 wt-% propylene oxide. In one embodiment, the alkoxylated triol has about 25 wt-% to about 65 wt-% ethylene oxide and about 35 wt-% to 75 wt-% propylene oxide. In one embodiment, the molecular weight of the alkoxylated triol is about 1,500 to about 10,000, about 2,000 to about 8,000, about 2,000 to about 6,000, or about 2,000 to 4,00. In one embodiment, the alkoxylated ethylenediamine comprises from about 20 wt-% to about 90 wt-%; from about 30 wt-% to about 80 wt-%; or from about 40 wt-% to about 80 wt-% of the combined weight of the two surfactants.

In one embodiment, the alkaline detergent compositions comprise an alkalinity source, a terpolymer and at least two non-ionic surfactants. In one embodiment, the surfactants comprise an alkoxylated triol and an alkoxylated ethylenediamine, and the alkaline detergent compositions comprise from about 1 wt-% to 80 wt-% sodium hydroxide, and from about 1 wt-% to about 10 wt-% of the two surfactants. In one embodiment, the alkoxylated triol comprises from about 10 wt-% to about 80 wt-%; 10 wt-% to about 60 wt-%; from about 15 wt-% to about 50 wt-%; or from about 15 wt-% to about 40 wt-% of the combined weight of the two surfactants. In one embodiment, the alkoxylated triol has about 20 wt-% to about 80 wt-% ethylene oxide (EO) and about 50 wt-% to 80 wt-% propylene oxide (PO). In one embodiment, the alkoxylated triol has about 20 wt-% to about 80 wt-% ethylene oxide and about 20 wt-% to 80 wt-% propylene oxide. In one embodiment, the alkoxylated triol has about 25 wt-% to about 55 wt-% ethylene oxide and about 30 wt-% to 60 wt-% propylene oxide. In one embodiment, the molecular weight of the alkoxylated triol is about 1,500 to about 10,000, about 2,000 to about 8,000, about 2,000 to about 6,000, or abou 2,000 to 4,000, In one embodiment, the alkoxylated ethylenediamine comprises from about 40 wt-% to about 90 wt-%; from about 50 wt-% to about 85 wt-%; or from about 60 wt-% to about 80 wt-% of the combined weight of the two surfactants. In one embodiment, the molecular weight of the alkoxylated ethylenediamine is about about 6,000 to about 8,000, or about 7,000 to 8,600. In one embodiment, the terpolymer comprises about 70 wt-% to about 90 wt-% acrylic acid, about 5 wt-% to about 20 wt-% maleic or itaconic acid, and about 1 wt-% to about 15 wt % 2-acrylamido 2-methylpropane, vinyl, styrene, allyl or methallyl sulfonic acid.

In one embodiment, the alkaline detergent compositions comprise an alkalinity source, a terpolymer comprising acrylic acid, maleic or itaconic acid, and 2-acrylamido 2-methylpropane sulfonic acid, vinyl sulfonic acid, styrene sulfonic acid, allyl sulfonic acid or methallyl sulfonic acid, and at least two non-ionic surfactants including a poly (propylene oxide)-poly(ethylene oxide)-poly(propylene oxide) block copolymer and an alkoxylated ethylenediamine. In one embodiment, the alkaline detergent compositions comprise from about 1 wt-% to abourt 80 wt-% sodium hydroxide or sodium carbonate, and from about 1 wt-% to about 10 wt-% of the two surfactants, and the alkoxylated ethylenediamine comprises from about 20 wt-% to about 90 wt-%; from about 30 wt-% to about 80 wt-%; or from about 40 wt-% to about 80 wt-% of the combined weight of the two surfactants. In one embodiment, the alkaline detergent composition comprises from about 1 wt-% to about 10 wt-% of the two surfactants, and the poly(propylene oxide)-poly(ethylene oxide)-poly(propylene oxide) block copolymer comprises from about 10 wt-% to about 90 wt-%; from about 15 wt-% to about 80 wt-%; or from about 15 wt-% to about 70 wt-% of the combined weight of the two surfactants. In one embodiment, the ratio of EO to PO in the poly(propylene oxide)-poly(ethylene oxide)-poly(propylene oxide) block copolymer is 3:7, 2:8, or 4:6. In one embodiment, the molecular weight of the alkoxylated ethylenediamine is about about 1,000 to about 10,000, or about 4,000 to 9,000. In one embodiment, the terpolymer comprises about 70 wt-% to about 90 wt-% acrylic acid, about 5 wt-% to about 20 wt-% maleic acid or itaconic acid, and about 1 wt-% to about 15 wt % 2-acrylamido 2-methylpropane, vinyl, styrene, allyl or methallyl sulfonic acid.

Other exemplary embodiments are shown below in Table 1.

TABLE 1A

| Material | First Exemplary Range wt-% | Second Exemplary Range wt-% | Third Exemplary Range wt-% | Fourth Exemplary Range wt-% |
|---|---|---|---|---|
| Alkali metal alkalinity source | 1-80 | 5-70 | 20-70 | 45-70 |
| Terpolymer | 1-20 | 1-15 | 2.5-15 | 5-15 |
| Additional Functional Ingredients | 0-20 | 0-15 | 0-10 | 0-15 |

TABLE 1B

| Material | First Exemplary Range wt-% | Second Exemplary Range wt-% | Third Exemplary Range wt-% | Fourth Exemplary Range wt-% |
|---|---|---|---|---|
| Alkali metal alkalinity source | 1-80 | 5-70 | 20-80 | 45-70 |
| Alkoxylated triol and alkoxylated ethylenediamine | 1-10 | 2-10 | 2.5-10 | 1-5 |
| Additional Functional Ingredients | 0-20 | 0-15 | 0-10 | 0-15 |

TABLE 1C

| Material | First Exemplary Range wt-% | Second Exemplary Range wt-% | Third Exemplary Range wt-% | Fourth Exemplary Range wt-% |
|---|---|---|---|---|
| Alkali metal alkalinity source | 1-80 | 5-70 | 20-70 | 45-70 |
| Reverse poloxamer (e.g., poly(propylene oxide)-poly(ethylene oxide)-poly(propylene oxide) and alkoxylated ethylenediamine | 1-10 | 2-10 | 2.5-10 | 1-5 |
| Additional Functional Ingredients | 0-20 | 0-15 | 0-10 | 0-15 |

TABLE 1D

| Material | First Exemplary Range wt-% | Second Exemplary Range wt-% | Third Exemplary Range wt-% | Fourth Exemplary Range wt-% |
|---|---|---|---|---|
| Alkali metal alkalinity source | 1-80 | 5-70 | 20-70 | 45-70 |
| Terpolymer | 1-20 | 1-15 | 2.5-15 | 5-15 |
| Alkoxylated triol and alkoxylated ethylenediamine | 1-10 | 2-10 | 2.5-10 | 1-5 |
| Additional Functional Ingredients | 0-25 | 0-20 | 0-10 | 0-10 |

TABLE 1E

| Material | First Exemplary Range wt-% | Second Exemplary Range wt-% | Third Exemplary Range wt-% | Fourth Exemplary Range wt-% |
|---|---|---|---|---|
| Alkali metal alkalinity source | 1-80 | 5-70 | 20-80 | 45-70 |
| Terpolymer | 1-20 | 1-15 | 2.5-15 | 5-15 |
| Reverse poloxamer (e.g., poly(propylene oxide)-poly(ethylene oxide)-poly(propylene oxide) and alkoxylated ethylenediamine | 1-10 | 2-10 | 2.5-10 | 1-5 |
| Additional Functional Ingredients | 0-25 | 0-20 | 0-10 | 0-10 |

Aminocarboxylates

In one embodiment, the detergent compositions may include an aminocarboxylate (or aminocarboxylic acid materials). In one aspect, the aminocarboxylates include aminocarboxylic acid materials containing little or no NTA. Exemplary aminocarboxylates include, for example, N-hydroxyethylaminodiacetic acid, ethylenediaminetetraacetic acid (EDTA), methylglycinediacetic acid (MGDA), hydroxyethylenediaminetetraacetic acid, diethylenetriaminepentaacetic acid, N-hydroxyethyl-ethylenediaminetriacetic acid (HEDTA), glutamic acid N,N-diacetic acid (GLDA), diethylenetriaminepentaacetic acid (DTPA), Iminodisuccinic acid (IDS), ethylenediamine disuccinic acid (EDDS), 3-hydroxy-2,2-iminodisuccinic acid (HIDS), hydroxyethyliminodiacetic acid (HEIDA) and other similar acids having an amino group with a carboxylic acid substituent. In an aspect, the aminocarboxylate is ethylenediaminetetraacetic acid (EDTA).

In an aspect, the compositions include from about 1 wt-% to about 25 wt-% aminocarboxylates, from about 1 wt-% to about 20 wt-% aminocarboxylates, from about 1 wt-% to about 15 wt-% aminocarboxylates, and preferably from about 5 wt-% to about 15 wt-% aminocarboxylates. In addition, without being limited according to the invention, all ranges recited are inclusive of the numbers defining the range and include each integer within the defined range.

Other Optional Surfactants

Other optional surfactants may include defoaming agents that may include silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein for all purposes.

Other optional nonionic low foaming surfactants include:

Polyoxyalkylene surface-active agents which are advantageously used in the compositions of this disclosure correspond to the formula: $P[(C_3H_6O)_n(C_2H_4O)_mH]_x$ wherein P is the residue of an organic compound having from 8 to 18 carbon atoms and containing x reactive hydrogen atoms in which x has a value of 1 or 2, n has a value such that the molecular weight of the polyoxyethylene portion is at least 44 and m has a value such that the oxypropylene content of the molecule is from 10% to 90% by weight. In either case the oxypropylene chains may contain optionally, but advantageously, small amounts of ethylene oxide and the oxyethylene chains may contain also optionally, but advantageously, small amounts of propylene oxide.

Alkoxylated amines include alcohol alkoxylated/aminated/alkoxylated surfactants. These non-ionic surfactants may be at least in part represented by the general formulae:

$$R^{20}\text{—}(PO)_sN\text{-}(EO)_tH,$$

$$R_20\text{-}(PO)_sN\text{-}(EO)_tH(EO)_uH, \text{ and}$$

$$R^{20}\text{-}(EO)_tH;$$

in which $R^{20}$ is an alkyl, alkenyl or other aliphatic group, or an alkyl-aryl group of from 8 to 20, e.g., 12 to 14 carbon atoms, EO is oxyethylene, PO is oxypropylene, s is 1 to 20, e.g., 2-5, t is 1-10, e.g., 2-5, and u is 1-10, e.g., 2-5. Other variations on the scope of these compounds may be represented by the alternative formula:

$$R^{20}\text{—}(PO)_v\text{—}N[(EO)_wH][(EO)_zH]$$

in which $R^{20}$ is as defined above, v is 1 to 20 (e.g., 1, 2, 3, or 4 (e.g., 2)), and w and z are independently 1-10, e.g., 2-5. These compounds are represented commercially by a line of products sold by Huntsman Chemicals as nonionic surfactants.

Suitable amounts of the nonfoaming nonionic surfactant include between about 0.01% and about 15% by weight of the cleaning solution. Particularly suitable amounts include between about 0.1% and about 12% or between about 0.5% and about 10% by weight of the cleaning solution.

Additional Optional Functional Ingredients

The components of the detergent composition can further be combined with various functional components suitable for use in ware wash and other applications employing an alkaline detergent or cleaning composition. In some embodiments, the detergent composition including the terpolymer or two non-ionic surfactants, and alkalinity source, make up a large amount, e.g., from about 1 wt-% to about 90 wt-%, about 5 wt-% to about 80 wt-%, 10 wt-% to about 70 wt-%, about 40 wt-% to about 80 wt-% or even substantially all of the total weight of the detergent composition. For example, in some embodiments few or no additional functional ingredients are disposed therein.

In other embodiments, additional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning, specifically ware wash applications. However, other embodiments may include functional ingredients for use in other applications.

In other embodiments, the compositions may include additional alkalinity sources such as alkli metal borates, phosphates and percarbonates. The compositions may also include bleaching agents, solubility modifiers, dispersants, rinse aids, metal protecting agents, enzymes, stabilizing agents, corrosion inhibitors, metal catalysts, additional sequestrants and/or chelating agents, fragrances and/or dyes, rheology modifiers or thickeners, hydrotropes or couplers, buffers, solvents and the like.

Phosphonates

In some embodiments, the compositions include a phosphonate. Examples of phosphonates include, but are not limited to: phosphinosuccinic acid oligomer (PSO) described in U.S. Pat. Nos. 8,871,699 and 9,255,242; 2-phosphinobutane-1,2,4-tricarboxylic acid (PBTC), 1-hydroxyethane-1,1-diphosphonic acid, $CH_2C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine(pentamethylenephosphonic acid), $(HO_2)POCH_2N[(CH_2)_2N[CH_2PO(OH)_2]_2]_2$; monoethanolamine phosphonate (MEAP); diglycolamine phosphonate (DGAP) and phosphorus acid, $H_3PO_3$. Exemplary phosphonates are PBTC, HEDP, ATMP and DTPMP. A neutralized or alkali phosphonate, or a combination of the phosphonate with an alkali source prior to being added into the mixture such that there is little or no heat or gas generated by a neutralization reaction when the phosphonate is added may be employed. In one embodiment, however, the composition is phosphorous-free.

Suitable amounts of the phosphonates include between about 0% and about 25% by weight of the composition, between about 0.1% and about 20%, or between about 0.5% and about 15% by weight of the composition.

Optional Surfactants

In some embodiments, the compositions of the present disclosure include a surfactant. Surfactants suitable for use with the compositions of the present disclosure include, but are not limited to, additional nonionic surfactants, anionic surfactants, cationic surfactants and zwitterionic surfactants. In some embodiments, the compositions of the present disclosure include about 0 wt-% to about 50 wt-% of a surfactant, or from about 0 wt-% to about 25 wt-% of a surfactant.

Anionic Surfactants

Also useful in the present disclosure are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. As those skilled in the art understand, anionics are excellent detersive surfactants and are therefore favored additions to heavy duty detergent compositions.

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, sulfonated fatty acids, such as sulfonated oleic acid, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

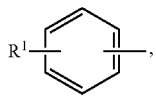

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

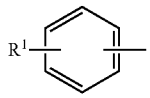

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Cationic Surfactants

Cationic Quaternary Surfactant/Quaternary Alkyl Amine Alkoxylate

The cationic quaternary surfactants are substances based on nitrogen centered cationic moieties with net positive change. Suitable cationic surfactants contain quaternary ammonium groups. Suitable cationic surfactants especially include those of the general formula: $N^{(+)}R^1R^2R^3R^4X^{(-)}$, wherein $R^1$, $R^2$, $R^3$ and $R^4$ independently of each other represent alkyl groups, aliphatic groups, aromatic groups, alkoxy groups, polyoxyalkylene groups, alkylamido groups, hydroxyalkyl groups, aryl groups, $H^+$ ions, each with from 1 to 22 carbon atoms, with the provision that at least one of the groups $R^1$, $R^2$, $R^3$ and $R^4$ has at least eight carbon atoms and wherein X(−) represents an anion, for example, a halogen, acetate, phosphate, nitrate or alkyl sulfate, e.g., a chloride. The aliphatic groups can also contain cross-linking or other groups, for example additional amino groups, in addition to the carbon and hydrogen atoms.

Particular cationic active ingredients include, for example, but are not limited to, alkyl dimethyl benzyl ammonium chloride (ADBAC), alkyl dimethyl ethylbenzyl ammonium chloride, dialkyl dimethyl ammonium chloride, benzethonium chloride, N,N-bis-(3-aminopropyl) dodecylamine, chlorhexidine gluconate, an organic and/or organic salt of chlorhexidene gluconate, PHMB (polyhexamethylene biguanide), salt of a biguanide, a substituted biguanide derivative, an organic salt of a quaternary ammonium containing compound or an inorganic salt of a quaternary ammonium containing compound or mixtures thereof.

Cationic surfactants include or refer to compounds containing at least one long carbon chain hydrophobic group and at least one positively charged nitrogen. The long carbon chain group may be attached directly to the nitrogen atom by simple substitution; or for example indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

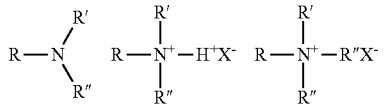

in which, R represents a long alkyl chain, R', R", and R'" may be either long alkyl chains or smaller alkyl or aryl groups or hydrogen and X represents an anion. The amine salts and quaternary ammonium compounds may be employed due to their high degree of water solubility.

Exemplary cationic quaternary ammonium compound can be schematically shown as:

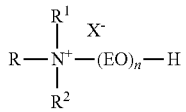

in which R represents a C8-C18 alkyl or alkenyl; $R^1$ and $R^2$ are C1-C4 alkyl groups; n is 10-25; and x is an anion selected from a halide or methyl sulfate.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present disclosure include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

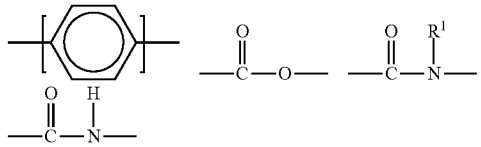

or an isomer or mixture of these structures, and which contains from 8 to 22 carbon atoms. The $R^1$ groups can additionally contain up to 12 ethoxy groups. m is a number from 1 to 3. In one embodiment, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, e.g., from 0 to 6. The remainder of any carbon atom positions on the Y group is filled by hydrogens.

Y can be a group including, but not limited to:

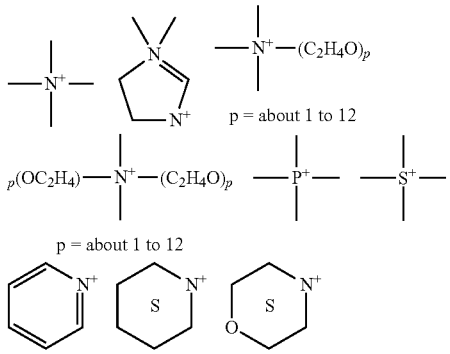

or a mixture thereof.

In one embodiment, L is 1 or 2, with the Y groups being separated by a moiety selected from $R^1$ and $R^2$ analogs (e.g., alkylene or alkenylene) having from 1 to 22 carbon atoms and two free carbon single bonds when L is 2. Z is a water soluble anion, such as sulfate, methylsulfate, hydroxide, or nitrate anion, for instance sulfate or methyl sulfate anions, in a number to give electrical neutrality of the cationic component.

Suitable concentrations of the cationic quaternary surfactant in the cleaning composition may include between about 0% and about 10% by weight of the cleaning composition.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" *Cosmetics & Toiletries*, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present disclosure generally have the general formula:

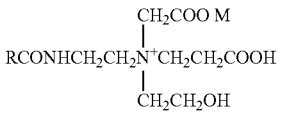

(MONO)ACETATE

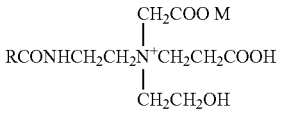

(DI)PROPIONATE

Neutral pH Zwitterion

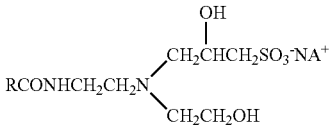

AMPHOTERIC SULFONATE wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this disclosure include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: C12-alkyl-C(O)—NH—$CH_2$—$CH_2$—$N^+$($CH_2$—$CH_2$—$CO_2Na)_2$—$CH_2$—$CH_2$—OH or $C_{12}$-alkyl-C(O)—N(H)—$CH_2$—$CH_2$—$N^+(CH_2$—$CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated by reference in their entirety.

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

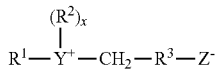

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonyio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

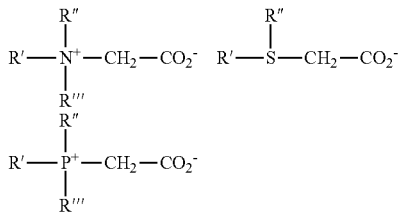

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present disclosure include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated in their entirety.

Enzymes

The solid alkaline compositions according to the disclosure can further include an enzyme to provide enhanced removal of soils, prevention of redeposition and additionally the reduction of foam in use solutions of the cleaning compositions. The purpose of the enzyme is to break down adherent soils, such as starch or proteinaceous materials, typically found in soiled surfaces and removed by a detergent composition into a wash water source. The enzyme compositions remove soils from substrates and prevent redeposition of soils on substrate surfaces. Enzymes provide additional cleaning and detergency benefits, such as anti-foaming.

Exemplary types of enzymes which can be incorporated into detergent compositions or detergent use solutions include amylase, protease, lipase, cellulase, cutinase, gluconase, peroxidase and/or mixtures thereof. An enzyme composition according to the disclosure may employ more than one enzyme, from any suitable origin, such as vegetable, animal, bacterial, fungal or yeast origin. However, according to one embodiment of the disclosure, the enzyme is a protease. As used herein, the terms "protease" or "proteinase" refer enzymes that catalyze the hydrolysis of peptide bonds.

As one skilled in the art shall ascertain, enzymes are designed to work with specific types of soils. For example, according to an embodiment of the disclosure, ware wash applications may use a protease enzyme as it is effective at the high temperatures of the ware wash machines and is effective in reducing protein-based soils. Protease enzymes are particularly advantageous for cleaning soils containing protein, such as blood, cutaneous scales, mucus, grass, food (e.g., egg, milk, spinach, meat residue, tomato sauce), or the like. Protease enzymes are capable of cleaving macromolecular protein links of amino acid residues and convert substrates into small fragments that are readily dissolved or dispersed into the aqueous use solution. Proteases are often referred to as detersive enzymes due to the ability to break soils through the chemical reaction known as hydrolysis. Protease enzymes can be obtained, for example, from *Bacillus subtilis, Bacillus licheniformis* and *Streptomyces griseus*. Protease enzymes are also commercially available as serine endoproteases. Examples of commercially-available protease enzymes are available under the following trade names: Esperase, Purafect, Purafect L, Purafect Ox, Everlase, Liquanase, Savinase, Prime L, Prosperase and Blap.

According to the disclosure, the enzyme may be varied based on the particular cleaning application and the types of soils in need of cleaning. For example, the temperature of a particular cleaning application will impact the enzymes selected for an enzyme composition according to the disclosure. Ware wash applications, for example, clean substrates at temperatures in excess of approximately 60° C., or in excess of approximately 70° C., or between approximately 65°-80° C., and enzymes such as proteases are desirable due to their ability to retain enzymatic activity at such elevated temperatures.

The enzymes may be an independent entity and/or may be formulated in combination with a detergent composition. In addition, enzyme compositions may be formulated into various delayed or controlled release formulations. For example, a solid molded detergent composition may be prepared without the addition of heat. As a skilled artisan will appreciate, enzymes tend to become denatured by the application of heat and therefore use of enzymes within detergent compositions require methods of forming a detergent composition that does not rely upon heat as a step in the formation process, such as solidification.

The enzyme may further be obtained commercially in a solid (i.e., puck, powder, etc.) or liquid formulation. Commercially-available enzymes are generally combined with stabilizers, buffers, cofactors and inert vehicles. The actual active enzyme content depends upon the method of manufacture, which is well known to a skilled artisan and such methods of manufacture are not critical to the present disclosure.

Alternatively, an enzyme(s) may be provided separate from the detergent composition, such as added directly to the wash liquor or wash water of a particular application of use, e.g. dishwasher.

Additional description of enzyme compositions suitable for use according to the disclosure is disclosed for example in U.S. Pat. Nos. 7,670,549, 7,723,281, 7,670,549, 7,553,806, 7,491,362, 6,638,902, 6,624,132, and 6,197,739 and U.S. Patent Publication Nos. 2012/0046211 and 2004/0072714, each of which are herein incorporated by reference in its entirety. In addition, the reference "Industrial Enzymes", Scott, D., in Kirk-Othmer Encyclopedia of Chemical Technology, 3rd Edition, (editors Grayson, M. and EcKroth, D.) Vol. 9, pp. 173-224, John Wiley & Sons, New York, 1980 is incorporated herein in its entirety.

In one aspect, the enzyme compositions are provided in a solid composition in an amount between about 0.01 wt-% to about 40 wt-%, between about 0.01 wt-% to about 30 wt-%, between about 0.01 wt-% to about 10 wt-%, between about 0.1 wt-% to about 5 wt-%, and for example between about 0.5 wt-% to about 1 wt-%.

Methods of Use

Detergent compositions according to the present disclosure provide alkali metal carbonate and/or alkali metal hydroxide alkaline detergents for cleaning a variety of industrial surfaces, e.g., in the food and beverage industry, washware and health care.

Articles can also be found in various industrial applications, food and beverage applications, healthcare, any other consumer markets where carbonate-based alkaline detergents (or alternatively hydroxide-based alkaline detergents) are employed. Suitable articles may include: industrial plants, maintenance and repair services, manufacturing facilities, kitchens, and restaurants.

The solid detergent compositions may include solid concentrate compositions. The solid compositions are diluted to form use compositions. In general, a concentrate refers to a composition that is intended to be diluted with water to provide a use solution that contacts an object to provide the desired cleaning, rinsing, or the like. The detergent composition that contacts the articles to be washed can be referred to as a concentrate or a use composition (or use solution) dependent upon the formulation employed in methods according to the disclosure. It should be understood that the concentration of the active components and other optional functional ingredients in the detergent composition will vary depending on whether the detergent composition is provided as a concentrate or as a use solution.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 10,000 but will depend on factors including water hardness, the amount of soil to be removed and the like. In an embodiment, the concentrate is diluted at a ratio of between about 1:10 and about 1:10,000 concentrate to water. For example, the concentrate is diluted at a ratio of between about 1:100 and about 1:5,000 concentrate to water, or the concentrate is diluted at a ratio of between about 1:250 and about 1:2,000 concentrate to water.

In an aspect, the alkaline detergent compositions may be used at use concentrations of at least about 500 ppm, at least 1000 ppm, or at 2000 ppm or greater. In some aspects, the alkaline detergent compositions may be used at use concentrations from about 500 ppm to 4000 ppm.

In an aspect, the alkaline detergent composition provides a use solution for contacting a surface in need of cleaning at pH greater than 7, or greater than 8, or greater than 9, or greater than 10.

Once contacted for a sufficient period of time, the soils on the surface in need of cleaning are loosened and/or removed from the article or surface. In some aspects the wares or articles may need to be "soaked" for a period of time. In some aspects, the contacting step such as submerging the ware or other article in need of soil removal further includes the use of warm water to form the pre-soak solution in contact with the stains for at least a few seconds, e.g., at least about 45 seconds to 24 hours, at least about 45 seconds to 6 hours, or at least about 45 seconds to 1 hour. In some aspects, wherein the pre-soak is applied within a warewash machine, the soaking period of time may be from about 2 seconds to 20 minutes in an institutional machine, and optionally longer in a consumer machine. In one aspect, the pre-soak is applied (e.g. ware is soaked in the alkaline fatty acid soap solution) for a period of at least 60 seconds, or at least 90 seconds. Beneficially, the soaking of ware or other soiled or stained articles according to the disclosure does not require agitation; however, use of agitation may be employed for further removal of soils.

As one skilled in the art will ascertain from the disclosure, the method can include more steps or fewer steps than laid out here.

Methods of Manufacture

The alkaline detergent compositions of the present disclosure can be formed by combining the components in the weight percentages and ratios disclosed herein. The alkaline compositions are provided as a solid and a use solution is formed during the warewashing processes (or other application of use).

Solid alkaline detergent compositions formed using the solidification matrix are produced using a batch or continuous mixing system. In an exemplary embodiment, a single- or twin-screw extruder is used to combine and mix one or more agents at high shear to form a homogeneous mixture. In some embodiments, the processing temperature is at or below the melting temperature of the components. The processed mixture may be dispensed from the mixer by forming, casting or other suitable means, whereupon the detergent composition hardens to a solid form. The structure of the matrix may be characterized according to its hardness, melting point, material distribution, crystal structure, and other like properties according to known methods in the art. Generally, a solid detergent composition processed according to the method of the disclosure is substantially homogeneous with regard to the distribution of ingredients throughout its mass and is dimensionally stable.

Specifically, in a forming process, the liquid and solid components are introduced into the final mixing system and are continuously mixed until the components form a substantially homogeneous semi-solid mixture in which the components are distributed throughout its mass. In an exemplary embodiment, the components are mixed in the mixing system for at least approximately 5 seconds. The mixture is then discharged from the mixing system into, or through, a die or other shaping means. The product is then packaged. In an exemplary embodiment, the formed composition begins to harden to a solid form in between approximately 1 minute and approximately 3 hours. Particularly, the formed composition begins to harden to a solid form in between approximately 1 minute and approximately 2 hours. More particularly, the formed composition begins to harden to a solid form in between approximately 1 minute and approximately 20 minutes.

Pressing can employ low pressures compared to conventional pressures used to form tablets or other conventional solid compositions. For example, in an embodiment, the present method employs a pressure on the solid of only less than or equal to about 5000 psi. In certain embodiments, the present method employs pressures of less than or equal to about 3500 psi, less than or equal to about 2500 psi, less than or equal to about 2000 psi, or less than or equal to about 1000 psi. In certain embodiments, the present method can employ pressures of about 1 to about 1000 psi, about 2 to about 900 psi, about 5 psi to about 800 psi, or about 10 psi to about 700 psi.

Specifically, in a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast composition begins to harden to a solid form in between approximately 1 minute and approximately 3 hours. Particularly, the cast composition begins to harden to a solid form in between approximately 1 minute and approximately 2 hours. More particularly, the cast composition begins to harden to a solid form in between approximately 1 minute and approximately 20 minutes.

By the term "solid form", it is meant that the hardened composition will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition. In general, it is expected that the detergent composition will remain in solid form when exposed to temperatures of up to approximately 100 degrees F. and particularly greater than approximately 120 degrees F.

The resulting solid detergent composition may take forms including, but not limited to: a pressed solid; a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the solidification matrix have a weight of between approximately 50 grams and approximately 250 grams, extruded solids formed by the solidification matrix have a weight of approximately 100 grams or greater, and solid block detergents formed by the solidification matrix have a mass of between approximately 1 and approximately 10 kilograms. The solid compositions provide for a stabilized source of functional materials. In some embodiments, the solid composition may be dissolved, for example, in an aqueous or other medium, to create a concentrated and/or use solution. The solution may be directed to a storage reservoir for later use and/or dilution, or may be applied directly to a point of use. Alternatively, the solid alkaline detergent composition is provided in the form of a unit dose, typically provided as a cast solid, an extruded pellet, or a tablet having a size of between approximately 1 gram and approximately 100 grams. In another alternative, multiple-use solids can be provided, such as a block or a plurality of pellets, and can be repeatedly used to generate aqueous detergent compositions for multiple cycles.

The invention will be further described by the following non-limiting examples.

EXAMPLES

Embodiments of the present disclosure are further defined in the following non-limiting Examples. It should be understood that these Examples, while indicating certain embodiments of the disclosure, are given by way of illustration only. From the above discussion and these Examples, one skilled in the art can ascertain the essential characteristics of this disclosure, and without departing from the spirit and scope thereof, can make various changes and modifications of the embodiments of the disclosure to adapt it to various usages and conditions. Thus, various modifications of the embodiments of the disclosure, in addition to those shown and described herein, will be apparent to those skilled in the art from the foregoing description. Such modifications are also intended to fall within the scope of the appended claims.

Example 1

A terpolymer containing detergent platform for controlling calcium carbonate scale accumulation on glass and plastic surfaces in auto warewashing applications was developed. In one example, the terpolymer comprises an acrylate terpolymer containing 2-acrylamido-2-meythylpropane sulfonic acid. In one embodiment, the terpolymers can be utilized in alkali metal hydroxide or carbonate based detergent compositions. The detergent compositions comprising acrylate terpolymers containing 2-acrylamido-2-meythylpropane sulfonic acid provide for effective hardness scale control and employ more cost-effective raw materials while maintaining or improving upon the performance of current technologies. Thus, the terpolymers are hardness scale inhibitors in alkaline detergent compositions. In one embodiment, the terpolymers are employed at a concentration above about 50 ppm in the detergent composition.

Materials

Pluronic N-3—Nonionic surfactant available from BASF Corporation

Acusol 448 (50% aqueous solution)—Copolymer of acrylic acid and maleic acid available from DOW Chemical Company 8026-067, 8113-005, 8113-006, 8113-030—terpolymers of acrylic acid, maleic acid, and 2-acrylamido-2-methylpropane sulfonic acid available from Nalco Water (see Table 2).

8273-009—terpolymer of acrylic acid, itaconic acid, and 2-acrylamido-2-methylpropane sulfonic acid available from Nalco Water (see Table 2).

TABLE 2

Exemplary acrylate terpolymers

| Terpolymer | Acrylic Acid (wt %) | MaleicAcid (wt %) | Itaconic Acid (wt %) | 2-acrylamido-2-methylpropane sulfonic acid (wt %) |
|---|---|---|---|---|
| 8026-067 | 70 | 20 | 0 | 10 |
| 8113-005 | 80 | 15 | 0 | 5 |
| 8113-006 | 85 | 10 | 0 | 5 |
| 8113-030 | 90 | 5 | 0 | 5 |
| 8273-009 | 85 | 0 | 10 | 5 |

Methods

Terpolymer

An exemplary synthetic method is as follows. Deionized water, maleic anhydride, and 50% sodium hydroxide solution were added to a reactor vessel with overhead paddle stirring, a nitrogen inlet, and a condenser. This mixture was stirred, e.g., from about 600 rpm to about 800 rpm, heated, e.g., from about 80° C. to about 100° C. and purged with nitrogen gas at about 1.0 L/min to about 2.5 L/min for 20 to 40 minutes. A solution of sodium persulfate ("SPS") in water and 50% aqueous hydrogen peroxide was prepared by stirring.

A plurality of semi-batch feeds were prepared for addition to the reactor. The SPS solution, acrylic acid, and a 50% aqueous ATBS solution were simultaneously added to the reactor over a period of time, e.g., about 150 to 200 minutes. In one embodiment, the SPS feed is for a longer period of time relative to the other feeds. After completion of the SPS feed, the reaction temperature was held at, for example, about 80° C. to about 100° C., for 20 to 40 minutes, and then cooled to room temperature.

For example, for polymer 8113-082, was formed as deionized water (210.80 g), maleic anhydride (40.0 g), and 50% sodium hydroxide solution (65.0 g) were added to a reactor vessel with overhead paddle stirring, a nitrogen inlet, and a condenser. This mixture was stirred at, e.g., from 650 rpm to 750 rpm, heated to between 90 and 100 degrees Celsius, and purged with nitrogen gas at 1.5 L/min for 30 minutes. A solution of sodium persulfate ("SPS") (30.0 g) in water (70.0 g) was prepared by stirring.

Four semi-batch feeds were prepared for addition to the reactor. The SPS solution was added to the reactor over 200 minutes, a 40% aqueous sodium bisulfate ("SBS") solution (200.0 g) was added to the reactor over 180 minutes, acrylic acid (340.0 g) was added to the reactor over 180 minutes, a 50% aqueous ATBS solution (44.20 g) was added to the reactor over 180 minutes. The addition of the SPS solution feed, the SBS solution feed, the acrylic acid feed, and the ATBS feed were started simultaneously. After completion, the reaction temperature was held at between 90 and 100 degrees Celsius for about 30 minutes and then cooled to room temperature.

One Hundred Cycle Test Method: Hard Water Film Evaluation for Institutional Warewash Detergents and Dishmachines Equipment:

1. Institutional dish machine hooked up to the appropriate water supply
2. Raburn 36 compartment glass rack (Ecolab part #6316-SH) 3. 6 Libbey heat resistant glass tumblers, 10 oz. Collins No. 53, Libbey part No. SCC 001071
4. 1 Cambro 10 oz. Newport Tumbler (NTlO).
5. 1, 6 inch piece of wire
6. Balance
7. Sufficient detergent to complete the test
8. Multi-Cycle Controller
9. Analytical Light Box
10. Diagnostic Instruments, Inx. Model 11.1 Monochrome W/IR Camera
11. SPOT Advance camera software
12. ImageJ software Reagents:

1. Ecolab Test Kit #415 (Ecolab part #55970) to test the detergent concentration (alkalinity and hardness kit)
2. Ecolab Test Kits #307 (Ecolab part #56309, #402 (Ecolab part #57030), or #415 (Ecolab part #55970) to test the water hardness
3. Detergent/Rinse Aid Formulation Preparation and Standardization of Reagents and Equipment:

1. Before each experiment, verify and record the water hardness using Ecolab test kit #307, #402 or #415.
2. Verify the detergent concentration using Ecolab test kit #415

Experimental Procedure:

1. Connect the inlet water line of the dishmachine to be used for testing to the desired water hardness valve. Turn on the dishmachine and any external booster heaters if needed. The machine should begin filling.
2. After the initial fill run the machine for a full wash cycle. Dump, fill, and repeat 2 more times prior to testing. This is done to ensure water conditions are consistent throughout testing.
3. Test the water hardness using test kit #307 (Ecolab part #56309), #402 (Ecolab part #57030), or #415 (Ecolab part #55970) and record the value. Adjust if necessary.
4. Place 6 glasses that have been processed according to IDTM-WW-005 and 1 new plastic cup in a Raburn 36 compartment rack (see configuration in Example 2). Be sure to use a piece of wire to secure the plastic cup in place to prevent it from flipping out of the rack.
5. Insert the desired chemistry into one of the dispensers that is attached to the dishmachine (Wash Max or Apex) and turn water supply to dispenser on.
6. Set the desired detergent set point (DSTP) on the APEX Controller based on the detergent being used.
7. Initiate a wash cycle to begin dispensing detergent.
8. Use Ecolab Test Kit #415 (Ecolab part #55970) to determine the detergent concentration by titrating the alkalinity.
9. Set the volume of rinse aid desired for the test, if any.
10. Once the desired concentration of detergent and rinse aid has been set and verified, place the rack of test glasses into the dishmachine.
11. Verify the desired cycle controller parameters. Close dishmachine door to initiate testing.
12. Allow the glasses to dry in the rack.

Visual Grading of Glasses

1. After the glasses have completely dried, line them up in the natural light box and turn off all room lights. Turn on one of the two natural light box lights and take one photo of the 6 glasses.

2. Under the same light and same orientation each glass and the plastic tumbler are given a visual score (1-5) for both their spotting and filming.

Film Evaluation of Glassware Using Image Analysis Software

1. Turn on both of the LED light sources in the analytical light box.

2. Adjust camera height on stand to 10'5/16" from the top of the light box.

3. Turn on the computer and camera and adjust the aperture of the lens to read 2.8.

4. Turn off all lights in room, removing any external light besides that from the LEDlights.

5. Insert the glass to be imaged into the glass holder, on its side. The glass should be horizontal (left to right) to the light sources. The surface of the glass should be perpendicular with the camera, the top end is positioned lower than the bottom end of the glass. Ensure the felt backing is placed within the insert. The fabric eliminates reflection from the metal insert and prevents interference when using image analysis.

6. Open the computer application "SPOT Advanced" from the desktop icon.

7. Adjust the image settings to the following specifications:

a. Bits per pixel: 12
b. External shutter: 35 ms
c. Exposure time: 155 ms
d. Gain: 1
e. Image type: brightfield-reflected light 8. Take a picture by clicking on the camera icon/expose which is located just below the Live icon in the toolbar on the right side of the screen and repeat for each of the six glass tumblers in the rack.

9. Open ImageJ software and open the picture file you want to analyze.

10. Run the following macro on the image:

a. makeRectangle (262, 328, 1184, 586);
run ("Crop");
run ("Rotate 90 Degrees Right");
makeRectangle (272, 360, 60, 366);
run ("Measure");

11. The glasses are ranked by the optical density ("Mean") measured in each glass. Average the measurements from the 6 glasses in each test for a composite score. Lower optical density indicates less film deposit on the glassware.

Results

Alkaline detergents that utilize an alkali metal hydroxide as a component in the formulation are commonly used in industrial warewash settings. The high pH of the detergent in the presence of hard water leads to obstacles in effective cleaning that include the deposition of calcium carbonate scale onto glass and plastic wares. Terpolymers of acrylic acid and maleic acid have been used as threshold agents for scale control in industrial alkaline detergents and show acceptable performance under many conditions. Polymaleic acid has been identified as a top performing scale inhibitor for use in industrial alkaline detergents, but can be cost prohibitive. As described herein, the incorporation of 2-acrylamido-2-methylpropane sulfonic acid into the backbone of an acrylic acid/maleic acid terpolymer leads to improved threshold inhibition of calcium carbonate scale on glass and plastic surfaces. These polymers have proven to be particularly useful for warewash applications between 150-180° F.

TABLE 3

Formulations for 100 Cycle Warewash Evaluations

| Raw Material | Negative Control | Formula 1 | Formula 2 | Formula 3 | Formula 4 | Formula 5 | Formula 6 |
|---|---|---|---|---|---|---|---|
| Sodium hydroxide bead | 35 | 45 | 56.3 | 56.7 | 56.1 | 56.3 | 47 |
| Sodium hydroxide, 50% | 60 | 40 | 16 | 16 | 16 | 15.2 | 35.4 |
| DI Water | 3 | 1 | 0 | 0 | 0 | 0 | 0 |
| Pluronic N-3 | 2 | 2 | 2 | 2 | 2 | 2 | 2 |
| Acusol 448, 50% | 0 | 12 | 0 | 0 | 0 | 0 | 0 |
| 8026-067, 23.37% | 0 | 0 | 25.7 | 0 | 0 | 0 | 0 |
| 8113-005, 23.69% | 0 | 0 | 0 | 25.3 | 0 | 0 | 0 |
| 8113-006, 23.14% | 0 | 0 | 0 | 0 | 25.9 | 0 | 0 |
| 8113-030, 22.64% | 0 | 0 | 0 | 0 | 0 | 26.5 | 0 |

TABLE 3-continued

| Formulations for 100 Cycle Warewash Evaluations | | | | | | | |
|---|---|---|---|---|---|---|---|
| Raw Material | Negative Control | Formula 1 | Formula 2 | Formula 3 | Formula 4 | Formula 5 | Formula 6 |
| 8273-009, 38.53% | 0 | 0 | 0 | 0 | 0 | 0 | 15.6 |
| Total | 100 | 100 | 100 | 100 | 100 | 100 | 100 |

To provide a standard method for evaluating hard water scale accumulation in an institutional warewash machine, a 100 cycle test method was employed. In this method, test glasses are washed one hundred times in an institutional dishmachine with a predetermined concentration of detergent to evaluate test formulations.

TABLE 4

| Image Analysis for 100 Cycle Results | | | |
|---|---|---|---|
| Formulation | Detergent Use Concentration (ppm) | Average optical density of glasses | Sum of optical density of glasses |
| Negative control | 1,000 | 65535 | 393210 |
| Formula 1 | 1,000 | 35523 | 213137 |
| Formula 2 | 1,000 | 30321 | 181923 |
| Formula 3 | 1,000 | 24427 | 146563 |
| Formula 4 | 1,000 | 33106 | 198637 |
| Formula 5 | 1,000 | 44575 | 267451 |
| Formula 6 | 1,000 | 12320 | 73919 |

TABLE 5

| Visual Grading for 100 Cycle Results | | | | | | | | |
|---|---|---|---|---|---|---|---|---|
| Formulation | Glass 1 | Glass 2 | Glass 3 | Glass 4 | Glass 5 | Glass 6 | Plastic | Average |
| Negative control | 5.0 | 5.0 | 5.0 | 5.0 | 5.0 | 5.0 | 5.0 | 5.0 |
| Formula 1 | 2.0 | 3.0 | 3.5 | 3.5 | 4.0 | 3.0 | 3.5 | 3.2 |
| Formula 2 | 1.5 | 3.0 | 3.5 | 3.5 | 3.0 | 2.5 | 3.5 | 2.9 |
| Formula 3 | 1.5 | 2.5 | 3.0 | 3.0 | 3.0 | 2.5 | 3.0 | 2.6 |
| Formula 4 | 2.0 | 4.0 | 3.5 | 4.0 | 3.5 | 3.0 | 3.0 | 3.3 |
| Formula 5 | 2.0 | 3.5 | 4.5 | 4.0 | 4.0 | 4.0 | 4.0 | 3.7 |
| Formula 6 | 1.0 | 2.0 | 2.0 | 1.5 | 1.5 | 1.0 | 4.0 | 1.9 |

Example 2

At high temperature, water hardness, and/or soil concentration, protein soil redeposits on plastic, glass, and melamine dishes. Compositions to prevent or inhibit protein foaming, prevent or inhibit filming and/or prevent or inhibit redeposition in institutional warewash applications at high temperature, water hardness, and/or sod concentration were prepared and tested. One of the compositions disclosed herein provides a blend of alkoxylated triol and alkoxylated ethlyenediamine which, when blended with an alkaline detergent containing an alkali metal hydroxide or carbonate and various polymers/chelants, defoams food soil and reduces its redeposition at high soil concentrations.

Methods 50-cycle test method (10 gpg water hardness, 160° F. wash/180° F. rinse)

Glewwe foam testing (10 gpg water hardness, 120-160° F. wash, 6 psi jet pressure, 50/50 beef stew/hotpoint soil)

50 Cycle Test

Equipment: 1) AM-15 dish washer
2) Raburn glass rack.
3) 6-Libbey heat resistant glass tumblers, 10 oz.
4) 2 plastic tumblers
5) 2 melamine tiles
6) 50/50 combination of beef stew and Hotpoint soil
7) Sufficient detergent to complete test.

Preparation and Standardization of Reagents and Equipment:

1) Obtain 6 clean Libbey glasses and two new plastic tumblers for each experiment.

2) Prepare a 50/50 combination of beef stew and hot point food soil, consisting of:

2 cans of Linty Moore Beef Stew (1360 g)
1 large can of tomato sauce (822 g)
15.5 sticks of Blue Bonnet Margarine (1746. g)
Powdered milk (436.4 g)

3) Fill the AM-15 Hobart dish machine (53 L sump, 2.8 L rinse). with water at the desired hardness. Titrate for grains of hardness.

4) Allow machine to heat until 180° F. final rinse temperature is achieved.

Experimental Procedure:

1) Weigh out doses of food soil and (if hand-dosed) detergent for each cycle, as well as initial dose(s) to charge the sump 2) Prime warewash machine with ingredients weighed out in step 1.

3) Place the glasses, plastic tumblers, and tiles in the rack as shown below (P=Plastic tumbler, G=glass tumbler, T=melarnine tiles)

| | | | | | | |
|---|---|---|---|---|---|---|
| | | | | | | G |
| | P | | | | G | |
| | T | | | G | | |
| | | G | | | T | |
| | G | | | | P | |
| G | | | | | | |

4) Run a total of 50 wash cycles on the dishes in the rack. Add one plastic glass per cycle containing pre-weighed ingredients to make up for the dilution caused by the rinse.

Evaluation/Scoring:

Evaluate filming on the spotlight box against a black background, to see spotting/filming clearly. Evaluate protein and determine an overall average and standard deviation for each set. The rating scale used is as follows (also can grade in ½ steps):

| Rating | Film/Spotting |
|---|---|
| 1 | No Film/Spotting |
| 2 | 20% of glass surface covered in :film/spotting |
| 3 | 40% of glass surface covered in :film/spotting |
| 4 | 60% of glass surface covered in :film/spotting |
| 5 | ~80% of glass surface covered in :film/spotting |

| Rating | Protein |
|---|---|
| 1 | No Protein |
| 2 | 20% of glass surface covered in protein |
| 3 | 40% of glass surface covered in protein |
| 4 | 60% of glass surface covered in protein |
| 5 | about 80% of glass surface covered in protein |

Glewwe Foaming Test

Equipment:

1) Glewwe foam machine
2) Timer
3) Balance & pipettes
4) Water of appropriate hardness
5) Appropriate food soil
6) Sufficient detergent to complete test.

Experimental Procedure:

1) Install the required jet on the stainless steel tubing assembly
2) Add 3 L water of the required hardness to the foam machine plastic cylinder-stainless steel beaker assembly.
3) Clear air from the lines and pump by completely opening the jet valve and cycling the machine on and off at 5 second intervals until the gauge reads at least 10 psi.
4) With the pump running, use steam and/or 0 gpg cooling water to reach the desired temperature.
5) Adjust the jet to 1-2 psi, add food soil and/or detergent to the sump, and run the jet for 30-60 sec to ensure a well-mixed sump.
6) Adjust the jet to 6 psi, then turn the machine off and wait for foam to subside. If necessary, speed foam breakage by rocking the machine's cart to create waves in the sump.
7) Turn the jet on for 1 minute, then turn off the jet and read foam height to the nearest ⅛" at 0 sec, 15 sec, and 60 sec after. If there is a variety of foam heights within the cylinder, record the average of the foam height.
8) To wash out the Glewwe foam machine, rinse down the sides of the cylinder and allow the water to drain. Close the drain valve and rinse the sides again, allowing the cylinder to fill up with about 1.5 liters of water. Turn the pump on and allow it to run for one minute. Turn the pump off and open the drain valve allowing it to drain. Repeat 3 to 4 times or until clean. Do not run the pump without water in the cylinder.

Results

An exemplary solid warewash detergent composition includes: about 60-70% sodium hydroxide and about 1-5% surfactant, and optionally one or more of about 5-10% water, about 5-10% phosphosuccinic oligomer, about 5-10% sodium gluconate, and about 5-10% acrylic-maleic copolymer (Acusol 448). The surfactant component is in one embodiment, by weight, a) 15-50% alkoxylated triol, and b) 50-85% ethylenediamine-poly(ethylene oxide)-polypropylene oxide) block copolymer, in which polyethylene oxide) constitutes 10-50% of the molecule by weight, and poly (propylene oxide) constitutes 50-90% of the molecule by weight. The detergent composition is diluted to form a solution for cleaning, e.g., plastic, glass, and melamine dishes in Institutional warewash applications.

The following compositions were tested.

TABLE 6

| Formula# | Total Detergent | Tetronic 90R4 | Dowfax DF-114 | SPXL Base |
|---|---|---|---|---|
| 1 | 450 ppm | 0% | 0.75% | 99.25% |
| 2 | 450 ppm | 4% | 0% | 96% |
| 3 | 450 ppm | 0% | 4% | 96% |
| 4 | 450 ppm | 2.67% | 1.33% | 96% |

SPXLBase

| Raw Material | % |
|---|---|
| Sodium Hydroxide | 66.23 |
| Water | 7.65 |
| Sodium Gluconate | 7.69 |
| Acusol448 | 8.06 |
| Phosphosuccinic Oligomer | 6.80 |
| Sodium Sulfate | 3.26 |
| Sodium Aluminate | 0.21 |
| Hexylene Glycol | 0.10 |
| Total | 100.00 |

Acusol 448 is an acrylic acid-maleic acid copolymer; PSO—phosphosuccinic oligomer;

Tetronic 90R4 is ethylenediamine-poly(ethylene oxide)-poly(propylene oxide), 4:6 EO:PO weight ratio; and Dowfax DF-114—is an alkoxylated triol surfactant (Dow)

Figure 1B:
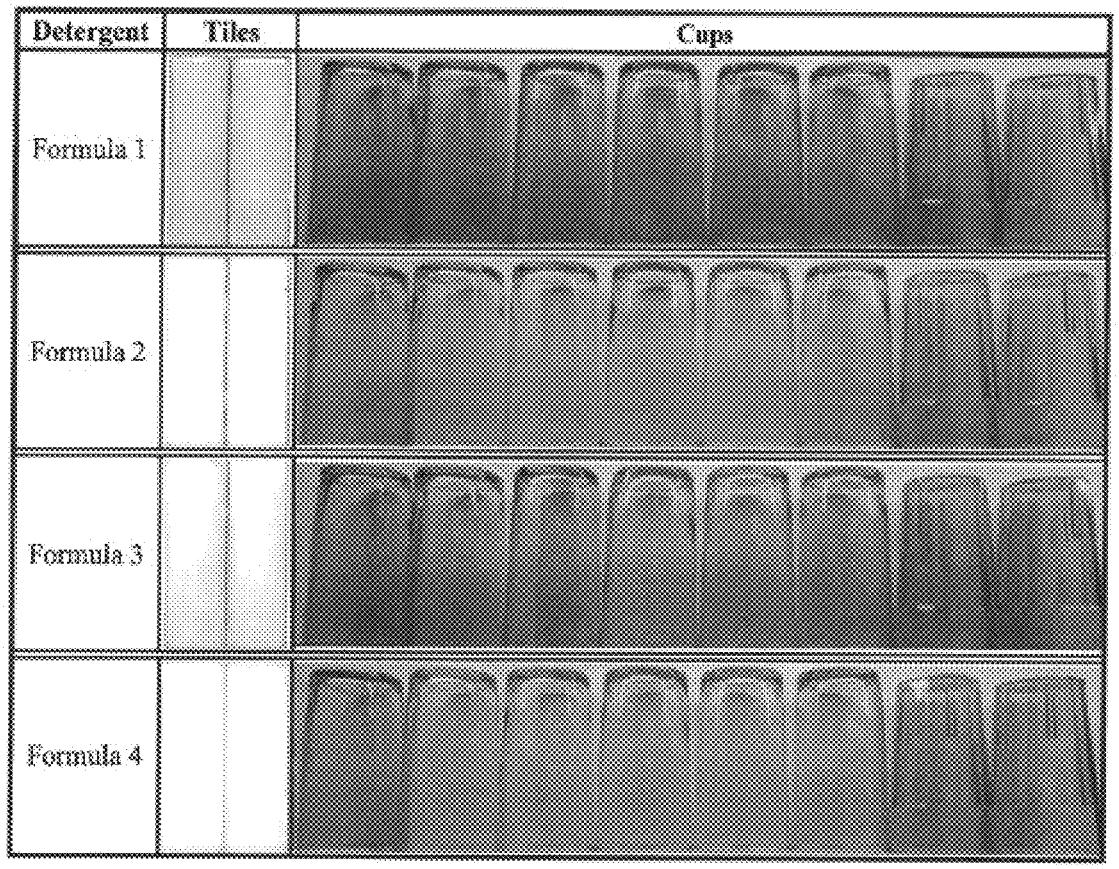
FIG. 1B. Results from 50 cycle testing using alkaline detergent compositions comprising Tetronic 90R4, Dowfax DF-114, or combinations thereof.

Results (in inches) of the Glewwe foaming test are shown below (see also FIG. 1):

TABLE 7

| | | 0 ppm food soil | | | 4000 ppm food soil | | |
|---|---|---|---|---|---|---|---|
| Detergent | Temp. | 0 sec | 15 sec | 60 sec | 0 sec | 15 sec | 60 sec |
| Formula 1 | 120° F. | 0 | 0 | 0 | 1 | ¼ | ⅛ |
| | 140° F. | 0 | 0 | 0 | ⅞ | ¼ | ¼ |
| | 160° F. | 0 | 0 | 0 | 1 | ½ | ¼ |
| Formula 2 | 120° F. | ½ | 0 | 0 | ¾ | ¼ | ¼ |
| | 140° F. | 0 | 0 | 0 | ⅛ | 0 | 0 |
| | 160° F. | 0 | 0 | 0 | 0 | 0 | 0 |
| Formula 3 | 120° F. | ½ | 0 | 0 | ⅝ | 0 | 0 |
| | 140° F. | ⅛ | 0 | 0 | ⅝ | 0 | 0 |
| | 160° F. | 0 | 0 | 0 | ½ | 0 | 0 |
| Formula 4 | 120° F. | ½ | 0 | 0 | ⅜ | 0 | 0 |
| | 140° F. | 0 | 0 | 0 | 0 | 0 | 0 |
| | 160° F. | 0 | 0 | 0 | 0 | 0 | 0 |

Example 3

The surfactant compositions may be present in the detergent compositions at about 1 wt-% to 5 wt-% and may include a) from about 15 to about 50 wt-% of a poloxamer or poly(propylene oxide)-polyethylene oxide)-poly(propylene oxide) block copolymer, such as Pluronic N-3 or Pluronic 25R2, and b) from about 50 to about 85 wt-% of an alkoxylated ethylene diamine such as a ethylenediamine-polyethylene oxide)-poly(propylene oxide) block copolymer, in which polyethylene oxide) constitutes about 10 wt-% to about 50 wt-% of the molecule by weight, and poly (propylene oxide) constitutes about 50 wt-% to about 90 wt-% of the molecule by weight.

The following compositions were tested using methods described in Example 2:

TABLE 8

| Chemical Compositions | | | | |
|---|---|---|---|---|
| Formula# | Total Detergent in Test Wash Solution | Tetronic 90R4 | Pluronic N3 | SPXL Base |
| 1 | 450 ppm | 0% | 0.75% | 99.25% |
| 2 | 450 ppm | 4% | 0% | 96% |
| 3 | 450 ppm | 3.5% | 0.5% | 96% |
| 4 | 600 ppm | 0 | 0.75% | 99.25% |
| 5 | 600 ppm | 2% | 2% | 96% |

| SPXLBase | |
|---|---|
| Raw Material | % |
| Sodium Hydroxide | 66.23 |
| Water | 7.65 |
| Sodium Gluconate | 7.69 |
| Acusol 448 | 8.06 |
| Phosphosuccinic Oligomer | 6.80 |
| Sodium Sulfate | 3.26 |
| Sodium Aluminate | 0.21 |
| Hexylene Glycol | 0.10 |
| Total | 100.00 |

Pluronic N3-polypropylene oxide)-poly(ethylene oxide)-poly(propylene oxide), 3:7 EO:PO weight ratio.

Figure 2A:
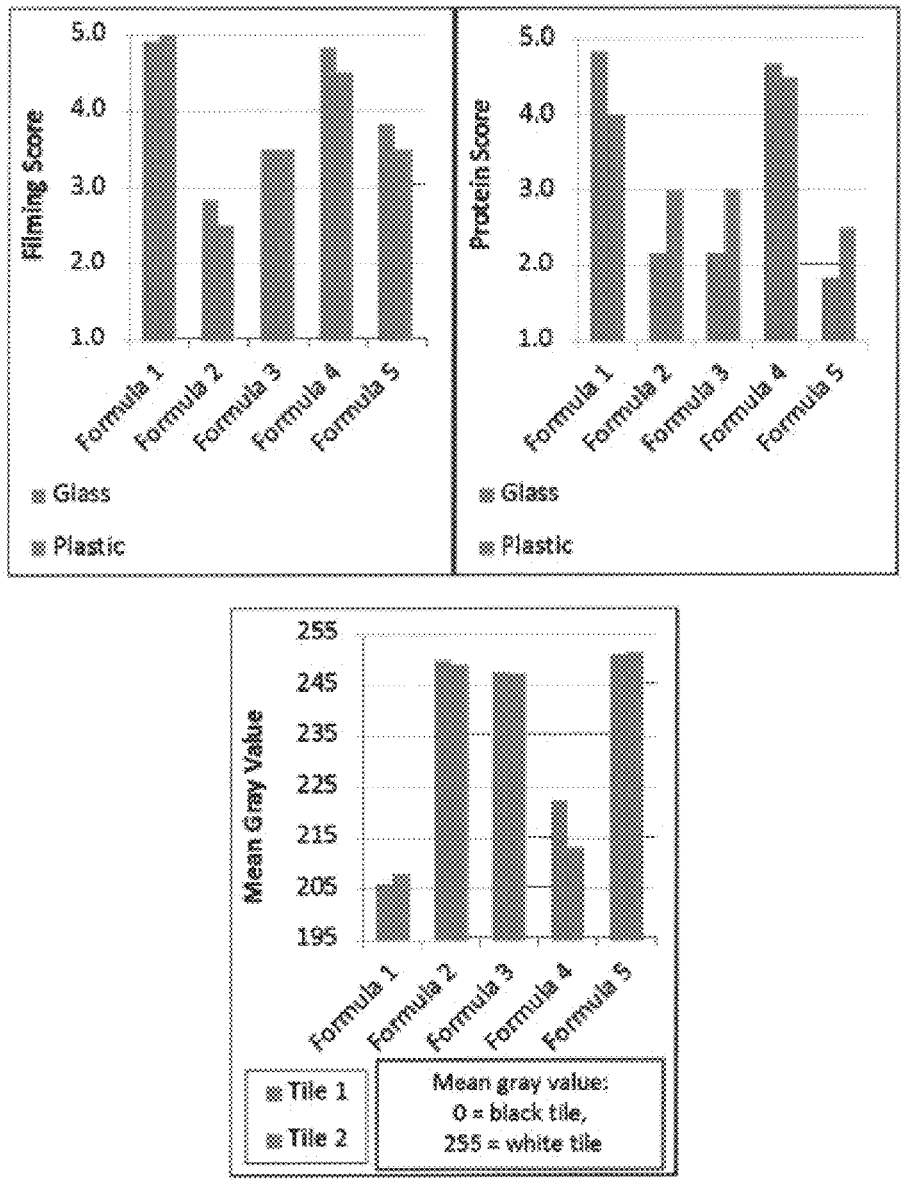
FIG. 2A. Foaming and filming results from alkaline detergent compositions comprising Tetronic Pluronic N3, or combinations thereof.
Figure 2B:
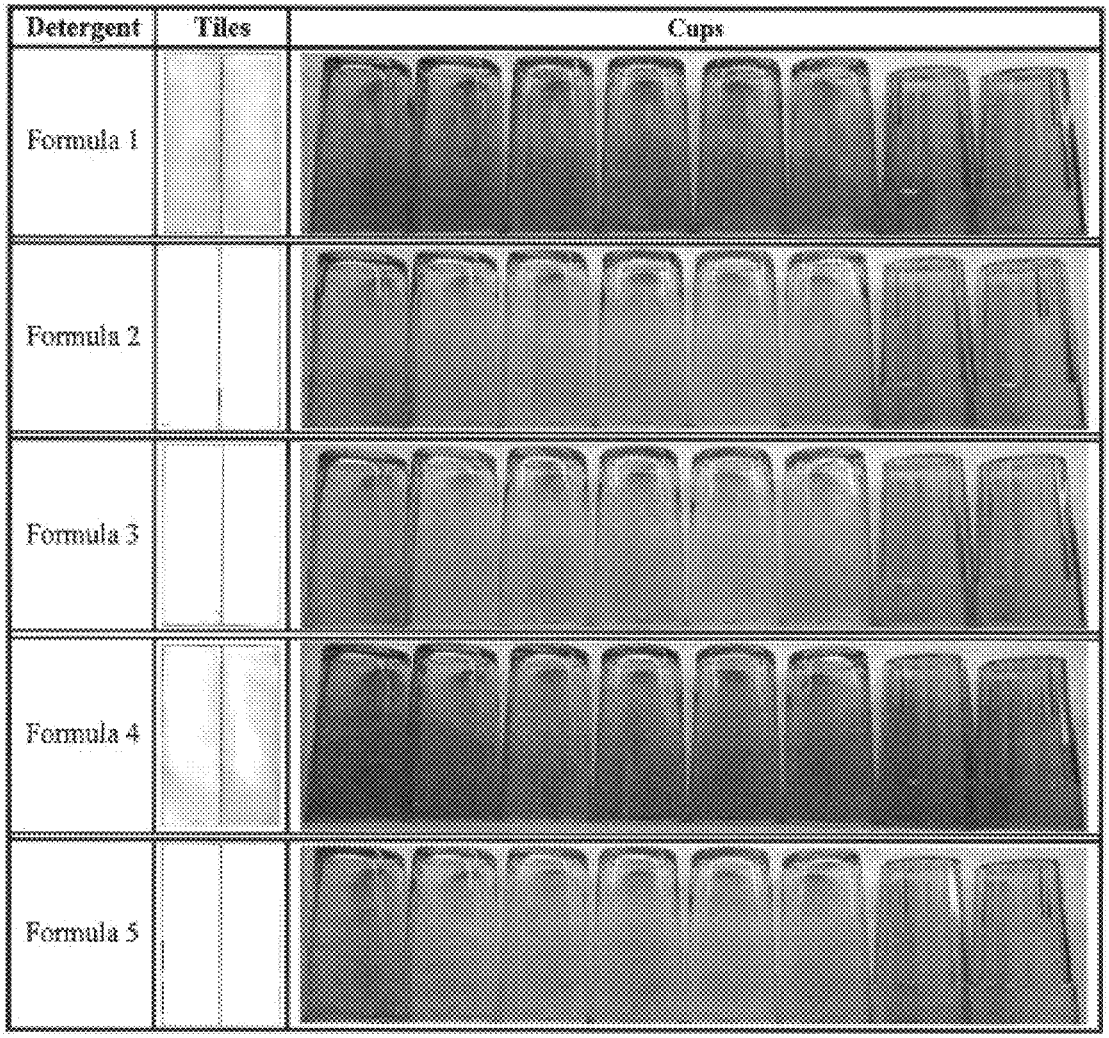
FIG. 2B. Results from 50 cycle testing using alkaline detergent compositions comprising Tetronic 90R4, Pluronic N3, or combinations thereof.
Figure 3:
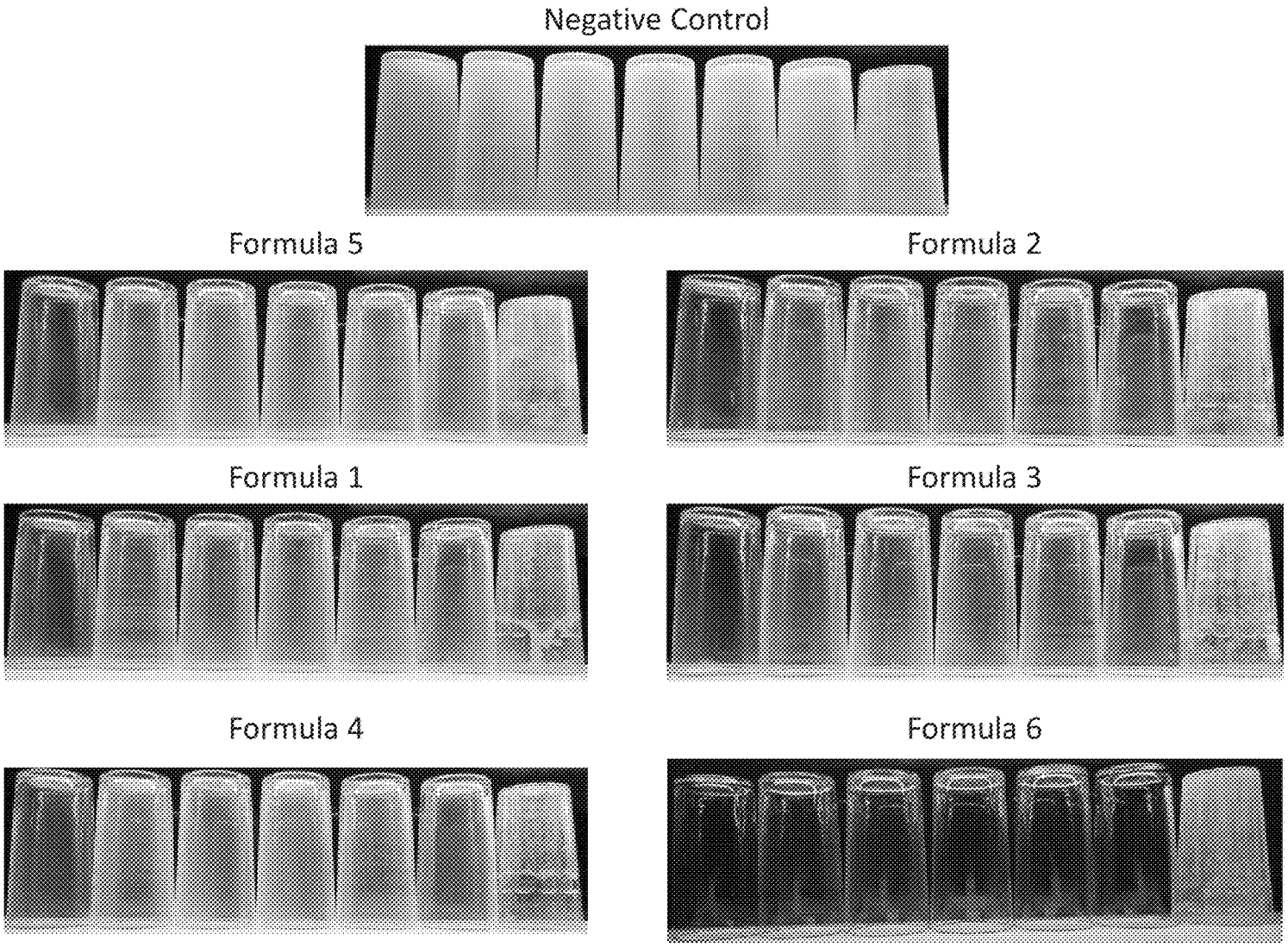
FIG. 3. Results from 100 cycle testing using alkaline detergent compositions comprising terpolymers of acrylic acid, maleic acid or itaconic acid, and a sulfonic acid.

Results (in inches) of the Glewwe foaming test are shown in Table 9 (see also FIG. 2). The conditions for the test were 50/50 beef stew/hotpoint soil, 120-160° F. water temperature, 10 gpg water hardness, 6 psi jet pressure.

TABLE 9

| | | 0 ppm food soil | | | 4000 ppm food soil | | |
|---|---|---|---|---|---|---|---|
| Detergent | Temp. | 0 sec | 15 sec | 60 sec | 0 sec | 15 sec | 60 sec |
| Formula 1 | 120° F. | 0 | 0 | 0 | 1 | ¼ | ⅛ |
| | 140° F. | 0 | 0 | 0 | ⅞ | ¼ | ¼ |
| | 160° F. | 0 | 0 | 0 | 1 | ½ | ¼ |
| Formula 2 | 120° F. | ½ | 0 | 0 | ¾ | ¼ | ¼ |
| | 140° F. | 0 | 0 | 0 | ⅛ | 0 | 0 |
| | 160° F. | 0 | 0 | 0 | 0 | 0 | 0 |
| Formula 3 | 120° F. | ½ | 0 | 0 | ⅛ | 0 | 0 |
| | 140° F. | ⅛ | 0 | 0 | 0 | 0 | 0 |
| | 160° F. | 0 | 0 | 0 | 0 | 0 | 0 |
| Formula 4 | 120° F. | 0 | 0 | 0 | 1 | ½ | ⅜ |
| | 140° F. | 0 | 0 | 0 | ¾ | ¼ | ¼ |
| | 160° F. | 0 | 0 | 0 | ¾ | ⅜ | ⅜ |
| Formula 5 | 120° F. | ¼ | 0 | 0 | 0 | 0 | 0 |
| | 140° F. | 0 | 0 | 0 | 0 | 0 | 0 |
| | 160° F. | 0 | 0 | 0 | 0 | 0 | 0 |

The above specification provides a description of the manufacture and use of the disclosed compositions and methods. Since many embodiments can be made without departing from the spirit and scope of the invention, the invention resides in the claims.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

What is claimed is:

1. An alkaline detergent composition, comprising: 1 wt-% to 80 wt-% of an alkalinity source comprising an alkali metal; and 1-wt % to 15 wt-% of a terpolymer comprising acrylic acid and maleic acid or acrylic acid and itaconic acid; and 2-acrylamido methylpropane sulfonic acid, vinyl sulfonic acid, styrene sulfonic acid, allyl sulfonic acid or methallyl sulfonic acid, wherein a) the alkalinity source comprises an alkali carbonate, an alkali metal hydroxide, or both, and the terpolymer comprises 80 wt-% to less than 85% wt-% acrylic acid, 10% wt-% to 19 wt-% maleic acid, and 1 wt-% to 15 wt-% 2-acrylamido 2-methyl propane sulfonic acid, vinyl sulfonic acid, styrene sulfonic acid, allyl sulfonic acid or methallyl sulfonic acid, b) the alkalinity source comprises an alkali carbonate, an alkali metal hydroxide, or both, and the terpolymer comprises 80 wt-% to 90 wt-% acrylic acid, 5 wt-% to 20% wt-% itaconic acid, and 5% wt-% to 10% wt-% 2-acrylamido 2-methylpropane sulfonic acid, vinyl sulfonic acid, styrene sulfonic acid, allyl sulfonic acid or methallyl sulfonic acid; or c) the alkalinity source comprises an alkali metal hydroxide and the terpolymer comprises 70 wt-% to 80 wt-% acrylic acid, 10 wt-% to 20 wt-% maleic acid and 1 wt-% to 15 wt % 2-acrylamido 2-methylpropane sulfonic acid, vinyl sulfonic acid, styrene sulfonic acid, allyl sulfonic acid or methallyl sulfonic acid, wherein the composition lacks a water soluble silicate, and wherein the terpolymer has a molecular weight of about 1,000 to about 50,000.

2. The composition of claim 1 further comprising at least two non-ionic surfactants.

3. The composition of claim 2 wherein at least one of the non-ionic surfactants is a defoaming agent.

4. The composition of claim 2 which comprises 1 wt-% to 10 wt-% of the at least two non-ionic surfactants.

5. The composition of claim 4 wherein one of the two non-ionic surfactants is a non-ionic alkoxylated triol surfactant present at 10 wt-% to 90-wt %.

6. The composition of claim 5 wherein the non-ionic alkoxylated triol surfactant comprises 10 wt-% to 80-wt % of ethylene oxide and 20 wt-% to 90-wt % of propylene oxide.

7. The composition of claim 4 wherein one of the two non-ionic surfactants is a poly(propylene oxide)-polyethylene oxide)-poly(propylene oxide) block copolymer which is present at 10 wt-% to 90 wt-%.

8. The composition of claim 4 wherein one of the two non-ionic surfactants is an ethylenediamine-polyethylene oxide)-poly(propylene oxide) block copolymer which is present at 20 wt-% to 90 wt-%, in which poly(ethylene oxide) is 10 wt-% to 90 wt-% of the molecule by weight, and poly(propylene oxide) is 20 wt-% to 90 wt-% of the molecule by weight.

9. The composition of claim 1 wherein the alkalinity source in a) or b) is the alkali metal hydroxide.

10. The composition of claim 1 wherein the terpolymer has a molecular weight of about 1,000 to about 20,000.

11. The composition of claim 1 further comprising one or more enzymes.

12. The composition of claim 1 which is an aqueous solution.

13. A method of inhibiting calcium carbonate deposition on a surface with a detergent composition, comprising: contacting a soiled surface with a detergent composition of claim 1 so as to inhibit calcium carbonate deposition.

14. The method of claim 13 wherein the contacting of the detergent composition comprises an initial step of generating a use solution of the detergent.

15. The method of claim 13 wherein the contacting of the detergent composition to the surface is at a use concentration of at least about 50 ppm, at least 400 ppm, or at least about 600 ppm.

16. The method of claim 13 wherein the contacting of the detergent composition to the surface is at a use concentration at from about 400 ppm to about 5000 ppm.

17. The method of claim 13 wherein the contacting is at a temperature of 120° F. or greater.

18. The method of claim 14 wherein the detergent s a solid.

* * * * *